US005716012A

United States Patent [19]

Foster

[11] Patent Number: 5,716,012

[45] Date of Patent: Feb. 10, 1998

[54] BULK MATERIAL HANDLING SYSTEM

[76] Inventor: Raymond Keith Foster, P.O. Box 1, Madras, Oreg. 97741

[21] Appl. No.: 560,799

[22] Filed: Nov. 21, 1995

[51] Int. Cl.[6] ..... B02C 19/00

[52] U.S. Cl. ..... 241/23; 241/27; 241/41; 241/65; 241/186.35; 241/DIG. 38

[58] Field of Search ..... 241/23, 27, 41, 241/186.35, DIG. 38, 102, 65

[56] References Cited

U.S. PATENT DOCUMENTS

| | | | |
|---|---|---|---|
| 3,604,179 | 9/1971 | Lund | 241/24.12 X |
| 3,993,256 | 11/1976 | Brewer | 241/186.35 X |
| 4,852,815 | 8/1989 | Giannotti | 241/65 |
| 5,205,495 | 4/1993 | Garnier | 241/31 |
| 5,233,932 | 8/1993 | Robertson | 241/DIG. 14 X |
| 5,419,670 | 5/1995 | Sommer, Jr. et al. | 414/412 |

*Primary Examiner*—John M. Husar
*Attorney, Agent, or Firm*—Delbert J. Barnard

[57] ABSTRACT

A garbage handling system (10) including a plurality of garbage collector bins (12) each provided with a reciprocating floor conveyor (50) and a movable, suspended chain assembly (30) at an outlet end (16) of a garbage collector bin for the purpose of breaking up accumulated garbage as the garbage is transferred out of the collector bin to a subsequent processing station, such as an incinerator. The size of each collector bin is large enough to hold several loads of garbage. The chain assembly is movable up and down, as well as laterally, to assist in breaking up garbage that has bound together while in the collector bin. The sidewalls (36) of collector bins (12) are angled inwardly to prevent garbage from becoming lodged between the sidewalls, preventing the reciprocating floor conveyor from moving the garbage.

30 Claims, 16 Drawing Sheets

BULK MATERIAL HANDLING SYSTEM

TECHNICAL FIELD

The present invention pertains to a bulk material handling system, and more particularly, to a system for collecting and handling garbage in a controlled manner so as to facilitate efficient disposal of the garbage.

BACKGROUND OF THE INVENTION

During garbage disposal operations, piles of garbage sit around for a while and tend to compact and bind together, rendering subsequent handling of the garbage more difficult. Also, when transporting garbage, more garbage can be hauled if the garbage is compacted. Consequently, garbage typically arrives at disposal sites already compacted. However, it is advantageous to have garbage broken up and loose when disposing of it to avoid the difficulties associated with handling large blocks or chunks of garbage. The present invention is directed to a garbage handling system that can break up compacted garbage or other types of bulk material that tend to clump together.

At many garbage handling facilities, garbage trucks unload garbage at numerous times throughout the day, usually after the trucks have picked up garbage from various transfer stations or recycling centers. At a garbage handling facility, the garbage is collected and stored, usually in piles, until ready for subsequent processing. An example of such a facility is a garbage incinerator plant.

For an incinerator to run efficiently, it needs to run continuously. Yet garbage is not collected around the clock, and, typically, it is not collected on weekends and holidays. Thus, for an incinerator to run continuously, it is necessary that a surplus of garbage be collected during the week, so that come the weekend, enough garbage is on hand for the incinerator to run until garbage collection resumes.

Currently, it is common practice to pile surplus garbage at the incinerator. A problem with piling garbage in this manner is that the garbage tends to compact, or bind together, as it collects in piles. Garbage compacts mainly due to its own weight, but also as a result of subsequent loads of garbage being dumped on top of the garbage. Compacted garbage tends to cling together somewhat, making the garbage difficult to handle and move. For example, larger blocks of garbage can clog conveyors, sometimes requiring manual break-up. Consequently, moving compacted garbage to the incinerator can be a difficult and time consuming task.

Furthermore, when transporting garbage to an incinerator, it is advantageous to compact the garbage, so that more garbage can be loaded into a garbage truck. When the compacted garbage is delivered to the incinerator, the compacted garbage creates a handling problem.

To avoid this problem, it is necessary to provide a system for collecting and storing garbage, breaking up compacted garbage, and moving garbage to an incinerator in a systematic, controlled, and uniform manner. The present invention is directed to the provision of just such a garbage handling system that is also simple in design, durable in construction, and which reliably operates to break up any compacted garbage prior to moving the garbage to the incinerator.

While the present invention was developed in combination with a garbage incinerator application, it is believed that the garbage handling system of the present invention is adaptable to handling many types of bulk material, such as wood products, industrial scraps, hay, or any other type of bulk material that may tend to bind together when piled or compacted.

DISCLOSURE OF THE INVENTION

Briefly described, the bulk material or garbage handling system of the present invention includes a collector bin for receiving bulk material and a bulk material break-up device positioned at an outlet end of the collector bin. The collector bin includes a floor, a pair of sidewalls, and an outlet end at one end of the collector bin. A reciprocating floor conveyor comprises the floor of the collector bin. The reciprocating floor conveyor includes a plurality of longitudinally-reciprocable conveyor slats for conveying bulk material through the collector bin and out the outlet end past the bulk material break-up device. The bulk material break-up device functions to loosen any bound or compacted bulk material as the bulk material moves out of the collector bin.

Preferably, the bulk material break-up device includes a plurality of chains suspended from above the bulk material. Some of the chains are provided with weights at their lower ends. As the bulk material moves out of the outlet end of the collector bin, the bulk material moves underneath the suspended chains, at which point the weighted chain links catch the bulk material and break up any bound portions of bulk material.

Additionally, the chains function to control the flow of bulk material out of the collector bin. A secondary conveyor may be provided at the outlet end of the collector bin, to receive bulk material from the collector bin and transfer it to a subsequent processing station, such as an incinerator. The chains slow the advancement of bulk material out of the collector bin, so that the bulk material drops onto the secondary conveyor in a uniform and controlled manner.

Preferably, the plurality of chains are attached to a movable support, such as a bar or rod, which is movable both laterally and vertically to assist in breaking up bound portions of bulk material. In addition, the movable support can pivot to allow the chains to move longitudinally along the conveyor in response to pulling forces on the chains caused by the bulk material.

The volume of the collector bin is sufficiently large to hold a two or three day supply of bulk material. The collector bin is sufficiently large to receive several loads of garbage prior to discharging the garbage, for example, to an incinerator. As a result, a large volume of garbage can be collected prior to operating the incinerator. The reciprocating floor conveyor is used to advance garbage into the collector bin as the garbage is transferred from a garbage truck. The reciprocating floor conveyor also is used to convey collected garbage out of the collector bin past the garbage break-up device.

According to an aspect of the invention, the sidewalls of the collector bin are angled inwardly toward each other, so that the spacing between upper portions of the sidewalls is less than the spacing between lower portions of the sidewalls. This somewhat trapezoidal design of the collector bin prevents bulk material from compacting and becoming lodged between the sidewalls, preventing the reciprocating floor conveyor from conveying the bulk material out of the collector bin. However, should the bulk material otherwise become lodged in the collector bin, the collector bin is wide enough to drive a plow through in order to clear the bulk material.

Preferably, the movable support also includes a pair of linear motors for moving the chain support bar. The linear motors are pivotally secured to the structure of the collector bin to allow the chains to move longitudinally along the conveyor as the linear motors pivot. Should the chains become hooked to the bulk material, the pivot connection for the support bar allows the chains some longitudinal leeway, which assists in freeing the chains from the bulk material.

With the garbage handling system of the present invention, bulk material, such as garbage, can accumulate in the collector bin as garbage is delivered to the bins and transferred to the incinerator. Then, during weekends and holidays, enough garbage is on hand to run the incinerator continuously during this period of no garbage delivery.

According to an alternative embodiment for the present invention, the bulk material breakup device includes one or more extendable rams that move into and out of the path of movement of the bulk material. In a preferred embodiment, three ram devices are positioned beneath the outlet end of the collector bin and are used to break up the bulk material should it clump together as it moves out of the outlet end of the collector bin. The rams are extendable by means of linear hydraulic motors, which are controlled in conjunction with the hydraulic circuitry for the reciprocating floor conveyor.

These and other advantages and features will become apparent from the following detailed description of the best mode for carrying out the invention and the accompanying drawings, and the claims, which are incorporated herein as part of the disclosure of the invention.

BRIEF DESCRIPTION OF THE DRAWINGS

Like reference numerals are used to indicate like parts throughout the various figures of the drawing, wherein.

BEST MODE FOR CARRYING OUT THE INVENTION

Figure 1:
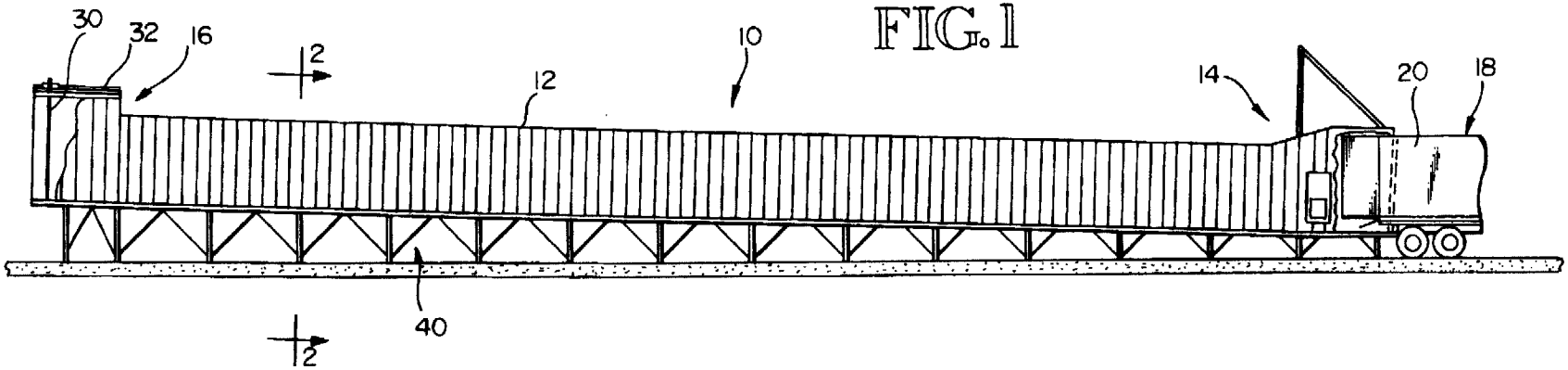
FIG. 1 is a side elevation view of a bulk material handling system constructed in accordance with a preferred embodiment of the present invention.

Referring now to FIG. 1, a bulk material handling system 10 built in accordance with a preferred embodiment of the present invention is shown in side elevation. The system 10 is designed to handle garbage, but can also handle other types of bulk material, especially bulk material that tends to bind together or become compacted from its own weight, such as, for example, manufacturing waste, wood scraps, and hay.

The system includes an elongated, rectangular hollow collector bin 12, having an inlet end 14 and an outlet end 16. Garbage is hauled to collector bin 12 by a garbage truck 18, the rear end of which is shown in FIG. 1. Garbage truck 18 includes a container 20, which carries garbage that typically has been compacted prior to being loaded into container 20. The garbage, typically, has been compacted by a compactor at a transfer station. Collector bin 12 is slightly larger in cross-section than container 20 so as to facilitate transfer of the garbage from container 20 to collector bin 12. Ideally, container 20 is equipped with a reciprocating floor conveyor for conveying garbage out of container 20 and into collector bin 12.

At outlet end 16 of collector bin 12, a chain wall assembly 30 is housed in an enlarged rectangular compartment 32. Compartment 32 is shown partially cut-away to illustrate chain wall assembly 30. Chain wall assembly 30 functions as a garbage break-up device and is discussed in more detail with reference to FIGS. 8–19.

Since garbage handling system 10 is designed to handle garbage that may contain liquids, collector bin 12 is inclined from inlet end 14 to outlet end 16. Support framework 40 elevates collector bin 12 and compartment 32 above the ground at an incline sufficient to drain any liquids that may drip from the garbage onto the floor of the collector bin. A suitable receptacle (not shown) can be provided at inlet end 14 to capture draining liquids.

Preferably, the length of collector bin 12 is long enough so that the collector bin can house a large volume of garbage. For example, a length of one hundred and fifty feet would be suitable for use at a garbage incinerator plant. However, the particular length of collector bin 12 can vary depending on the installation.

Figure 2:
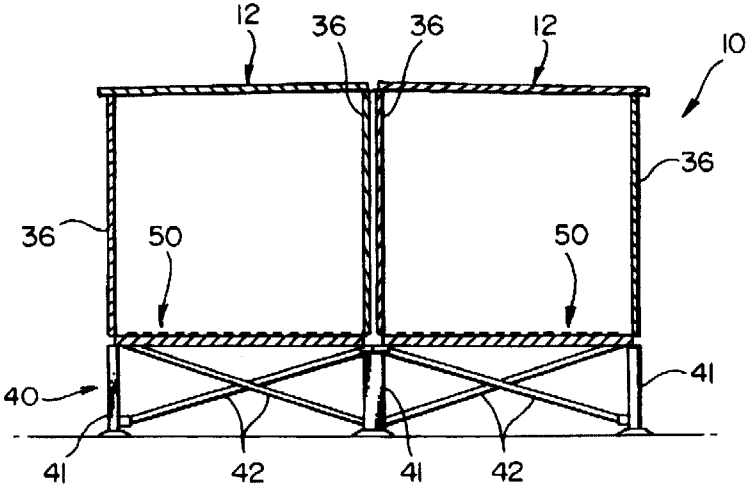
FIG. 2 is sectional view, taken along the line 2—2 of FIG. 1, showing the collector bins of the bulk material handling system of FIG. 1.

In FIG. 2, two collector bins 12 are shown installed side-by-side. Depending on the requirements of a particular garbage handling facility, two or more bins can be provided. In the embodiment shown, collector bins 12 are secured together to reinforce their sidewalls 36. It is important that the sidewalls be reinforced since garbage can be heavy and exert considerable forces on sidewalls 36. A single base structure 40 supports both collector bins 12. Base structure 40 includes upright columns 41 and diagonal cross-bracing 42. However, the particular design of base structure 40 forms no part of the invention, and any suitable support can be used. In FIG. 2, collector bins 12 are rectangular in cross-section and the dimensions of each collector bin 12 is equal to or slightly larger than the cross-sectional dimensions of the container of a garbage truck. For example, each collector bin 12 may be nine feet high and nine and one half feet in width.

Collector bins 12 may be used in combination with a garbage incinerator. In such an application, garbage is delivered to collector bins 12, and collector bins 12 transfer the incoming garbage to the incinerator. Typically, garbage is delivered to the incinerator on workdays only. On weekends and holidays, garbage collection stops. Since it is necessary for the incinerator to operate continuously, the volume of the collector bins should be sufficient so that upon termination of garbage delivery to the incinerator, the collector bins are substantially full and enough garbage is on hand for the incinerator to operate continuously until garbage delivery resumes. When garbage delivery does resume, garbage is delivered to the collector bins at a rate great enough both to operate the incinerator and to restock the collector bins.

Figure 3:
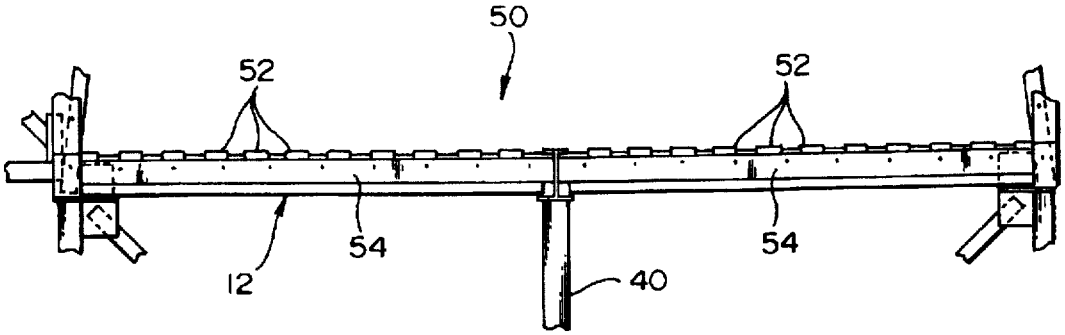
FIG. 3 is an enlarged detail view of the reciprocating floor conveyor mounted within the collector bins of the bulk material handling system of FIG. 1.

As shown in FIG. 3, the floor of each collector bin 12 includes a reciprocating floor conveyor 50. Each conveyor 50 includes an array of elongated conveyor slats 52 reciprocally mounted on a sub-frame 54. Reciprocating floor conveyors, in general, are well known in the art. However, the particular reciprocating floor conveyor used for the present invention forms the subject matter of my co-pending patent application, Ser. No. 08/390,759, entitled "Reciprocating Floor Conveyor and Floor Member," filed Feb. 17, 1995 now U.S. Pat. No. 5,482,155.

Figure 4:
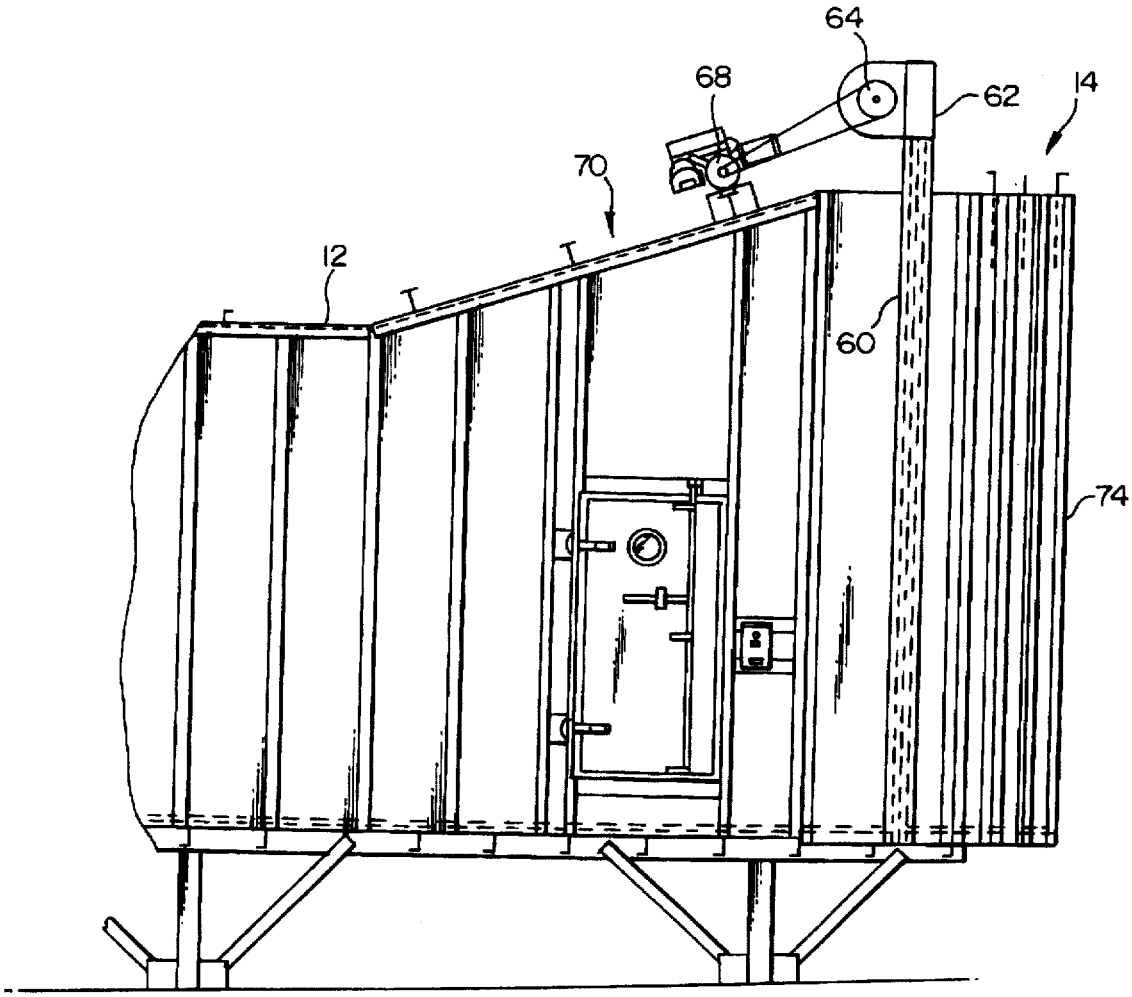
FIG. 4 is an enlarged side elevation view of the inlet end of the collector bin of the bulk material handling system of FIG. 1.

In FIG. 4, inlet end 14 of collector bin 12 is shown in more detail. At inlet end 14, an industrial grade rollup door 60 is provided. Rollup door 60 is carried on upright rails 62. A take-up drum 64 is supported between rails 62. A reversible electric motor 68 rotates drum 64 to raise and lower the door. Rollup door 60 is provided so that collector bin 12 can be closed off after garbage is loaded into the collector bin. Also, for some applications, it may be desirable to draw a vacuum within collector bin 12. In such applications, rollup door 60 can be provided with appropriate seals.

Inlet end 14 includes an enlarged section 70 into which the tail end of garbage truck is backed to unload garbage. Top, bottom, and side rubber seal flaps are provided around the periphery of the inlet opening 74 at inlet end 14. Also, the level of the reciprocating floor conveyor within collector bin 12 at inlet end 14 is lower than the level of the reciprocating floor conveyor within garbage truck. In operation, garbage drops a small distance as it is transferred from the garbage truck to the collector bin.

Refuse-derived fuel RDF is what is left over after recyclable material has been removed from garbage. The recyclable material removal process does not form a part of the present invention and is not illustrated. In the embodiment depicted in FIGS. 1–4, RDF is collected from a recycling process and then compacted and transported to the collector bins.

Figure 5:
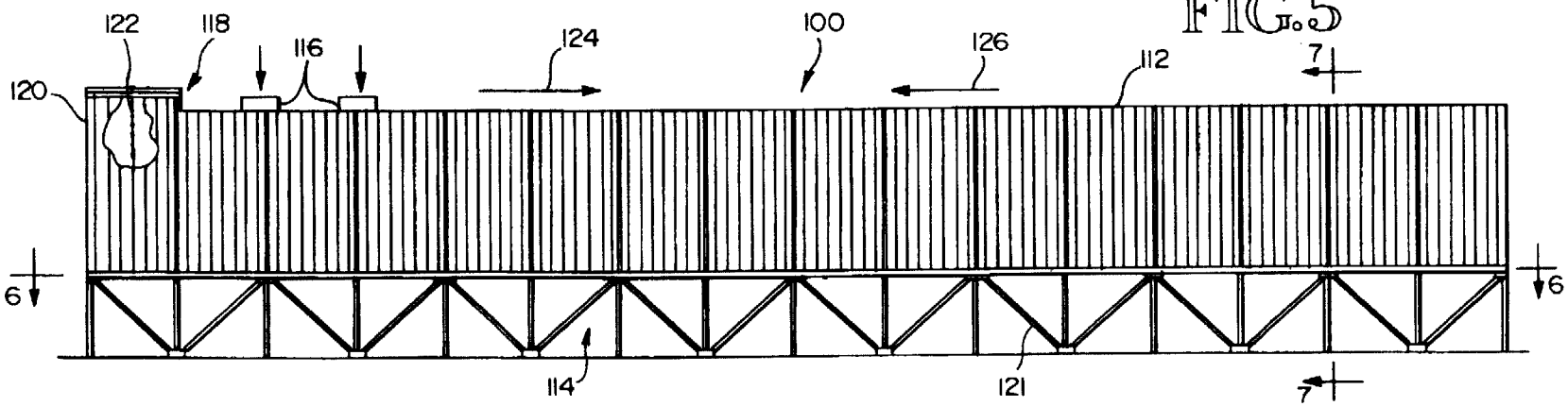
FIG. 5 is a side elevation view of an alternative embodiment of the bulk material handling system of FIG. 1.

In FIG. 5, however, an alternative embodiment is shown. RDF garbage handling system 100 is shown to include a rectangular collector bin 112 supported by base structure 114. Collector bin 112 does not have an inlet end, as does the collector bins 12 of FIGS. 1–4. A pair of inlet shoots 116 are provided at the top of collector bin 112 through which RDF is channeled into collector bin 112. Shoots 116 lead from a recyclable material removal processing station upstream of collector bin 112. Collector bin 112 also has a reciprocating floor conveyor (not shown) forming the floor of the bin.

Collector bin 112 includes an outlet end 118, where a compartment 120 with chain wall assembly 122 are attached to collector bin 112. Chain wall assembly 122 functions as a garbage break-up device and is discussed with reference to FIGS. 8–16.

Figure 6:
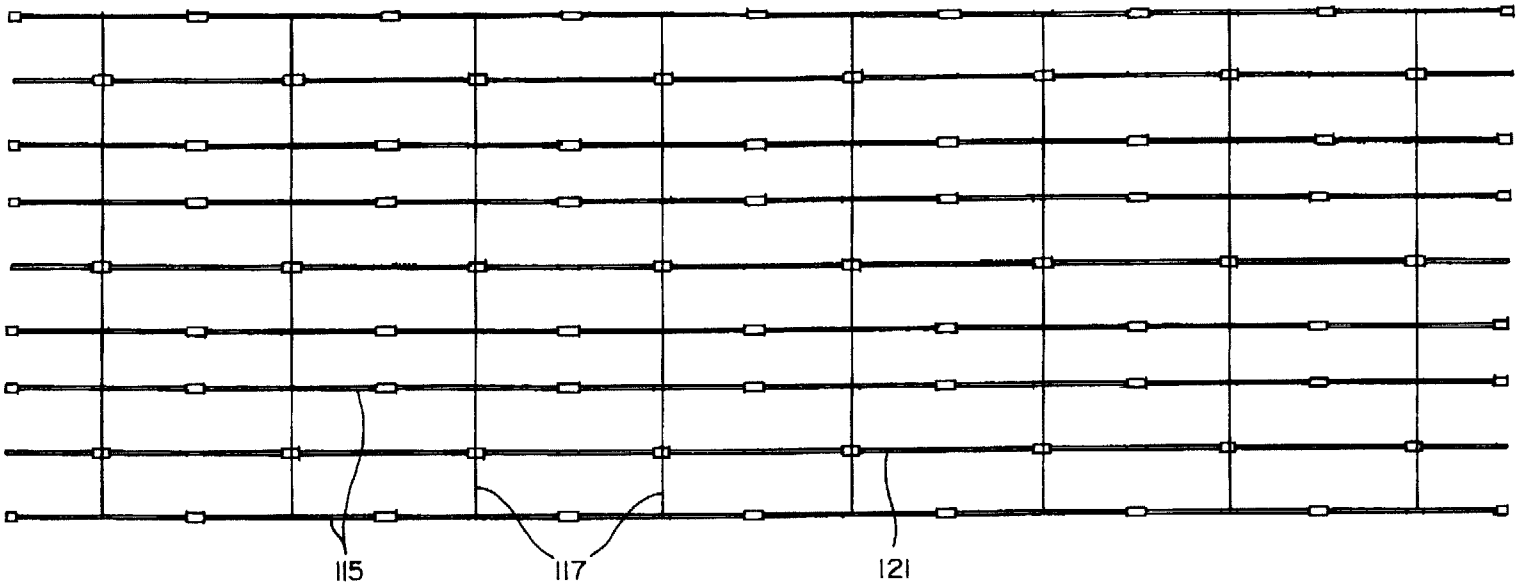
FIG. 6 is a sectional view, taken along the line 6—6 of FIG. 5, showing the base structure for the collector bins.

RDF handling system 100 includes three collector bins 112 assembled side-by-side, however, the number of collector bins is determined by the requirements of the garbage processing operation. FIG. 6 illustrates the base structure 114 for the collector bins. Framework 114 includes longitudinal members 115, cross members 117, and diagonal bracing 121.

With RDF handling system 100, garbage is dumped through shoots 116 down onto a reciprocating floor conveyor forming the floor of collector bin 112. The conveyor first moves the garbage away from outlet end 118, in the direction of arrow 124. When collector bin 112 is full of garbage, the conveyor moves the garbage back toward outlet end 118 past chain wall assembly 122, in the direction indicated by arrow 126. Collector bin 112 is not inclined toward outlet end 118 because RDF is usually dry material.

Figure 7:
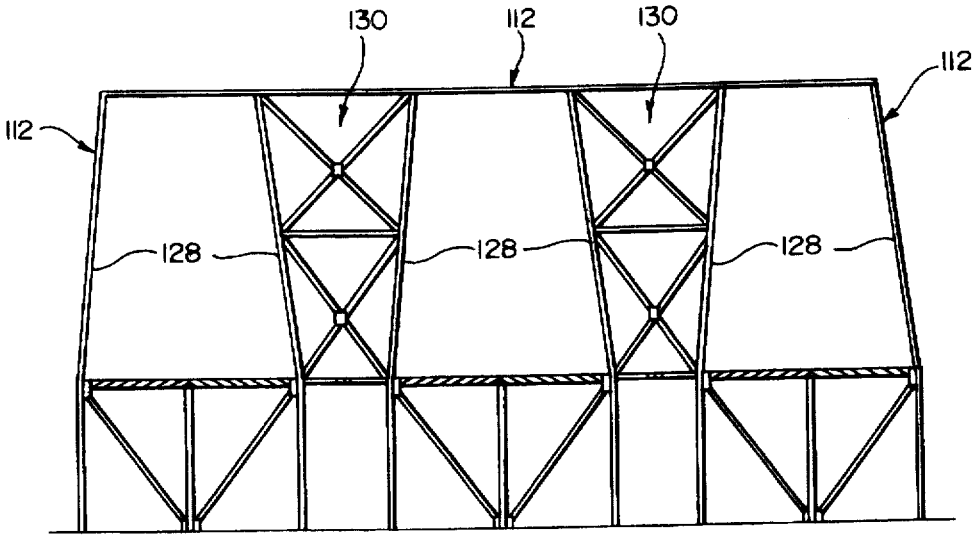
FIG. 7 is a sectional view, taken along the line 7—7 of FIG. 5, showing three collector bins.

FIG. 7 shows an alternate design for either of the collector bins 12 of FIGS. 1–4 or collector bins 112 of FIGS. 5, 6. Three collector bins 112 are arranged side-by-side and are spaced from each other. Collector bins 112 include sidewalls 128, which are inclined toward each other to form a trapezoid profile. The collector bins are trapezoidal in cross-section for an important reason. As bulk material, such as garbage, collects in the collector bins, it tends to compact slightly and bind together. When the reciprocating floor conveyor attempts to convey garbage out of the collector bins, the garbage may get caught up on the sidewalls and bridge itself across the conveyor floor. The inclined sidewalls are angled toward each other so that the spacing between upper portions of the sidewalls is less than the spacing between lower portions of the sidewalls. If garbage becomes compacted, inclined sidewalls 128 make it more difficult for the garbage to bridge itself between the sidewalls. However, should garbage manage to become lodged between the sidewalls, the garbage can be manually broken up.

In order to reinforce sidewalls 128 of bins 112, lateral bracing 130 is provided between collector bins 112. Bracing 130 is provided at locations spaced intermittently along the length of collector bins 112.

Figure 8:
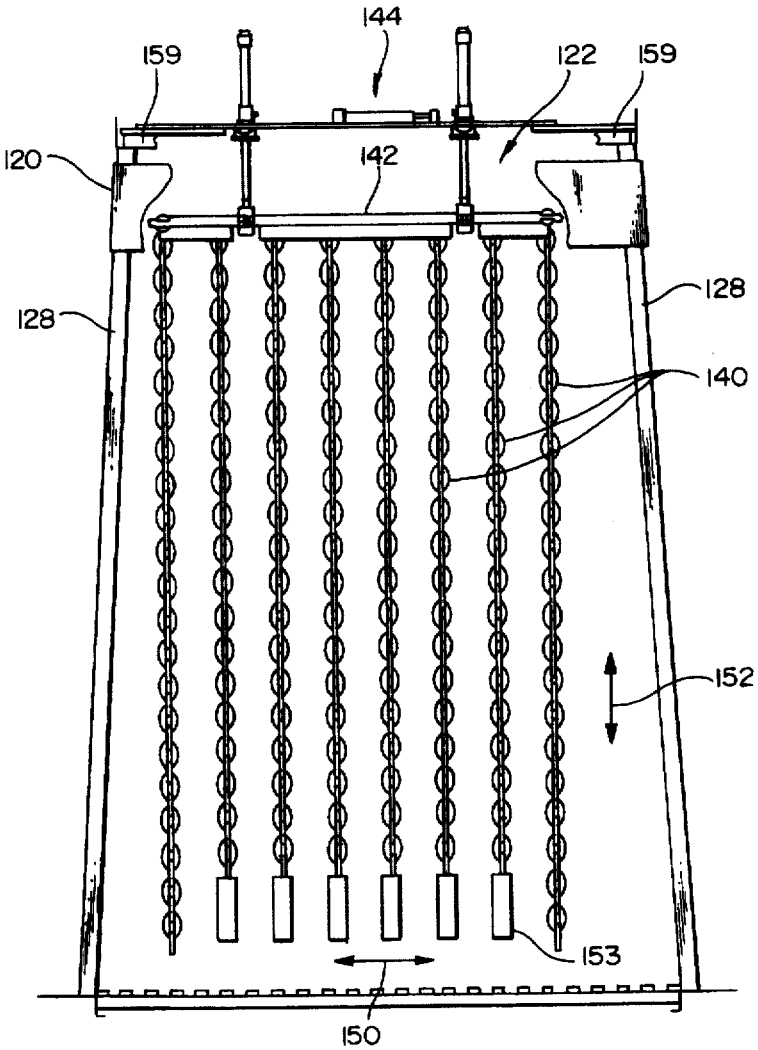
FIG. 8 is an end elevation view of the bulk material handling system of FIG. 3, showing a chain wall assembly at the outlet end of a collector bin.

In FIG. 8, a chain wall assembly 122 is shown. Chain wall assembly 122 is identical to chain wall assemblies 30 of FIG. 1. Each chain wall assembly 122 includes a plurality of chains 140 suspended from above by a movable support bar assembly 142. Chains 140 form a chain curtain, past which bulk material must move to exit a collector bin. A control assembly 144 is operably connected to support bar assembly 142. As will be discussed in more detail later, control assembly 144 moves chains 140 laterally back and forth, as shown by arrow 150, and up and down, as shown by arrow 152, in an effort to manipulate bulk material as it moves underneath chains 140. This serves to break up and separate the bulk material should any of it become bound or clumped together while in the collector bins. Weights 153 may be secured to the lower ends of chains 140 to assist in breaking up bulk material.

Chain wall assembly 122 is supported between sidewalls 128 of outlet compartment 120 by roof structure 159. The design of roof structure 159 forms no part of the invention and any suitable frame structure for supporting chain wall assembly 122 may be used to practice the invention.

Figure 9:
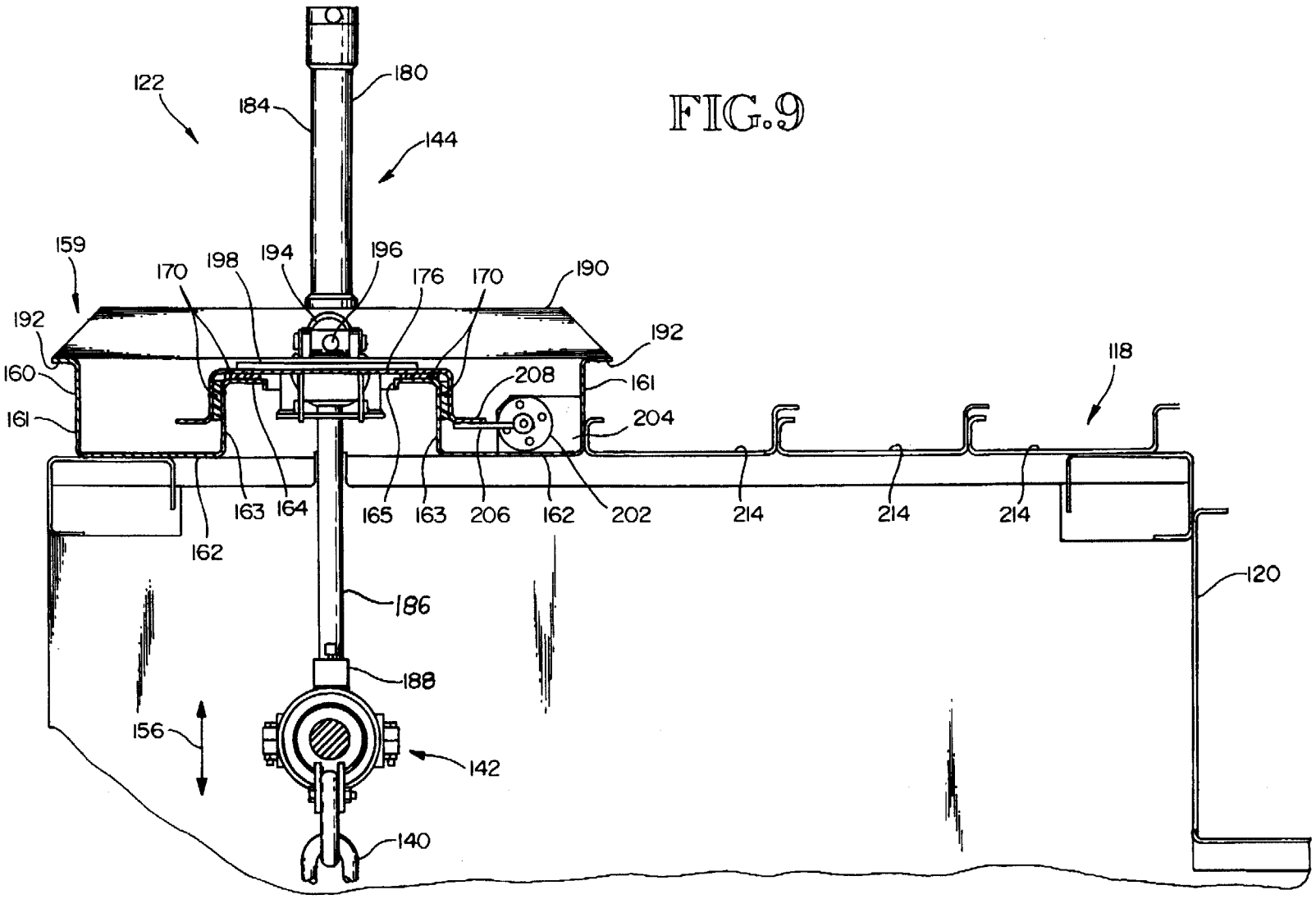
FIG. 9 is a sectional view of the upper portion of the outlet end of a collector bin.

Referring to FIG. 9, roof structure 159 is shown to include a formed channel section 160 having outer sidewalls 161, bottom panels 162, inner sidewalls 163, and a center panel 164. A slot 165 is formed in center panel 164, through which actuators 180, 182 extend. Channel section 160 spans the lateral width of outlet compartment 120. Bearing strips 170 are secured to sidewalls 163 and center panel 164 by any suitable means such as screws. Bearing strips 170 are made of a self-lubricating structural plastic material such as UHMW. An elongated inverted, U-shaped hat channel member 176 slidably rests on bearing strips 170. Mat channel member 176 carries chain wall assembly 122. As hat channel member 176 is reciprocated back and forth, in a manner discussed later, chain curtain 140 is moved laterally into and out of the page as shown in FIG. 9.

Chain wall assembly 122 includes a pair of vertical hydraulic linear motors 180, 182, only one of which is shown in FIG. 9. Each motor 180, 182 includes a cylinder component 184 and a piston component 186. Piston component 186 includes a piston head and a piston rod. Movable support bar assembly 142 is secured to the distal ends 188 of piston components 186. As vertical actuators 180, 182 are operated, and piston component 186 retracts into and extends from cylinder component 184, movable support bar assembly 142 and chain curtain 140 are moved up and down, as indicated by arrow 156.

Figure 10:
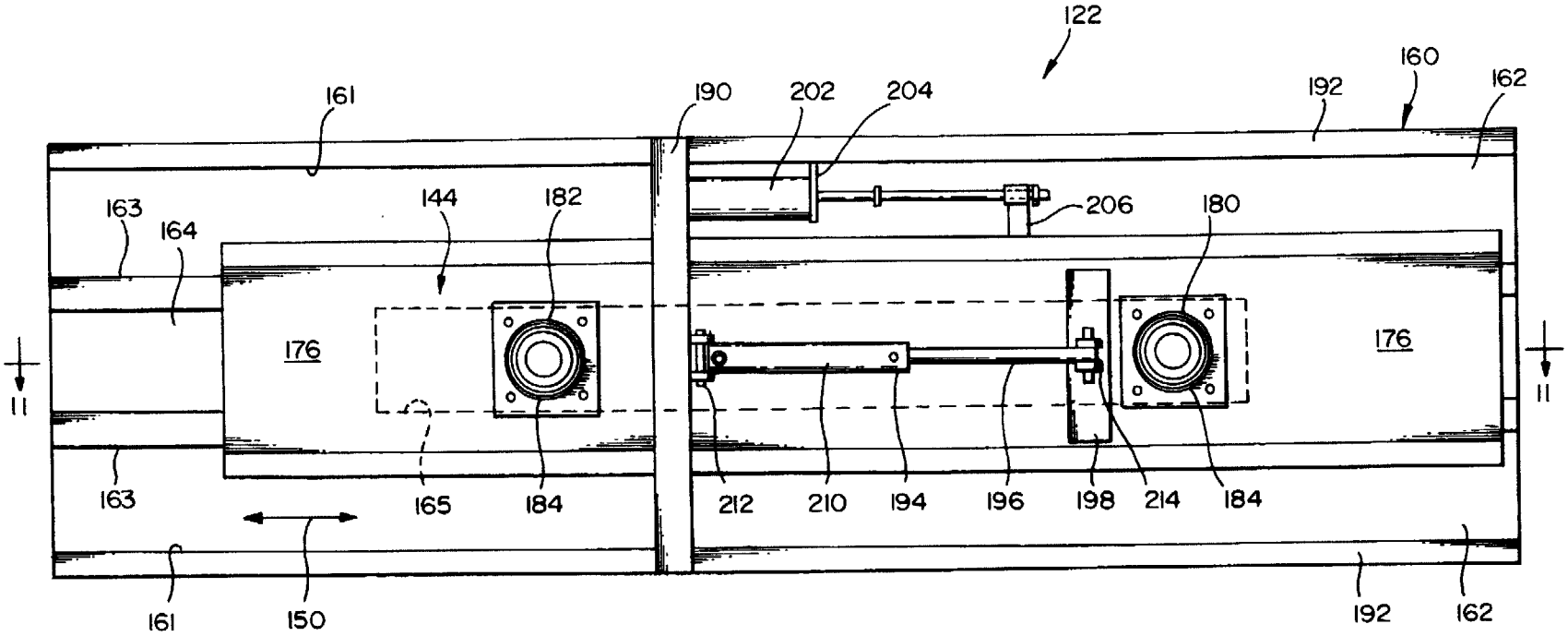
FIG. 10 is a plan view of a chain wall assembly.

Also shown in FIG. 9 is a short longitudinal tubular brace 190 that extends between and is mounted onto outside flanges 192 of channel section 160. Brace 190 secures one end of a horizontal hydraulic actuator 194 to channel section 160, thus fixing that end of actuator 194. The other end, the piston rod end 196 of actuator 194, is secured to a plate mount 198, which is secured to the top side of hat channel 176, as shown in FIGS. 9 and 10. As will be discussed in more detail later, when horizontal actuator 194 is operated, and piston rod 196 retracts into and extends out from horizontal actuator 194, plate mount 198 and hat channel section 176 are moved laterally (into and out of the page as shown in FIG. 9) to move chain curtain 140 laterally back and forth across the conveyor path above the reciprocating floor conveyor.

Control assembly 144 includes a switching valve 202 that is mounted to an upright bracket 204. Switching valve 202 controls operation of horizontal actuator 194. Bracket 204 is welded to channel section 160. The movable component of switching valve 202 is slidably interconnected with a sleeve and bracket piece 206. Bracket piece 206 is secured to the bottom of flange 208 of hat channel section 176. Switching valve 202 is discussed in more detail later.

The outlet end 118 of compartment 120 includes a series of inverted U-shaped panels 214, which form the remaining roof structure between channel section 160 and the inward end of compartment 120. Again, the frame structure for outlet end compartment 120 forms no part of the invention, with the illustrated embodiment of FIG. 9 being used exemplarily.

Referring to FIG. 10, a plan view of chain wall assembly 122 is shown. Vertical actuators 180, 182 are spaced apart along the length of hat channel section 176, and hat channel section 176 is shorter in length than the length of channel section 160. This length difference provides a sufficient amount of lateral movement for hat channel section 176. Slot 165 in hat channel 176 is shown in dashed line and can be seen to extend beyond actuators 180, 182. Actuators 180, 182 move back and forth laterally within slot 165.

Horizontal actuator 194 includes a cylinder component 210, which is secured by a clevis and pin 212 to longitudinal brace 190. Similarly, piston rod 196 is secured by clevis and pin 214 to plate 198. Operation of horizontal actuator 194 moves hat channel section 176 and control assembly 144 laterally, as shown by arrow 150, which, as previously discussed, moves the chain curtain laterally across the conveyor path to assist in breaking up clumped bulk material. The hydraulic connections to horizontal actuator 194 and vertical actuators 180, 182 are not shown, for clarity, but are discussed later with reference to FIGS. 14, 15.

Figure 11:
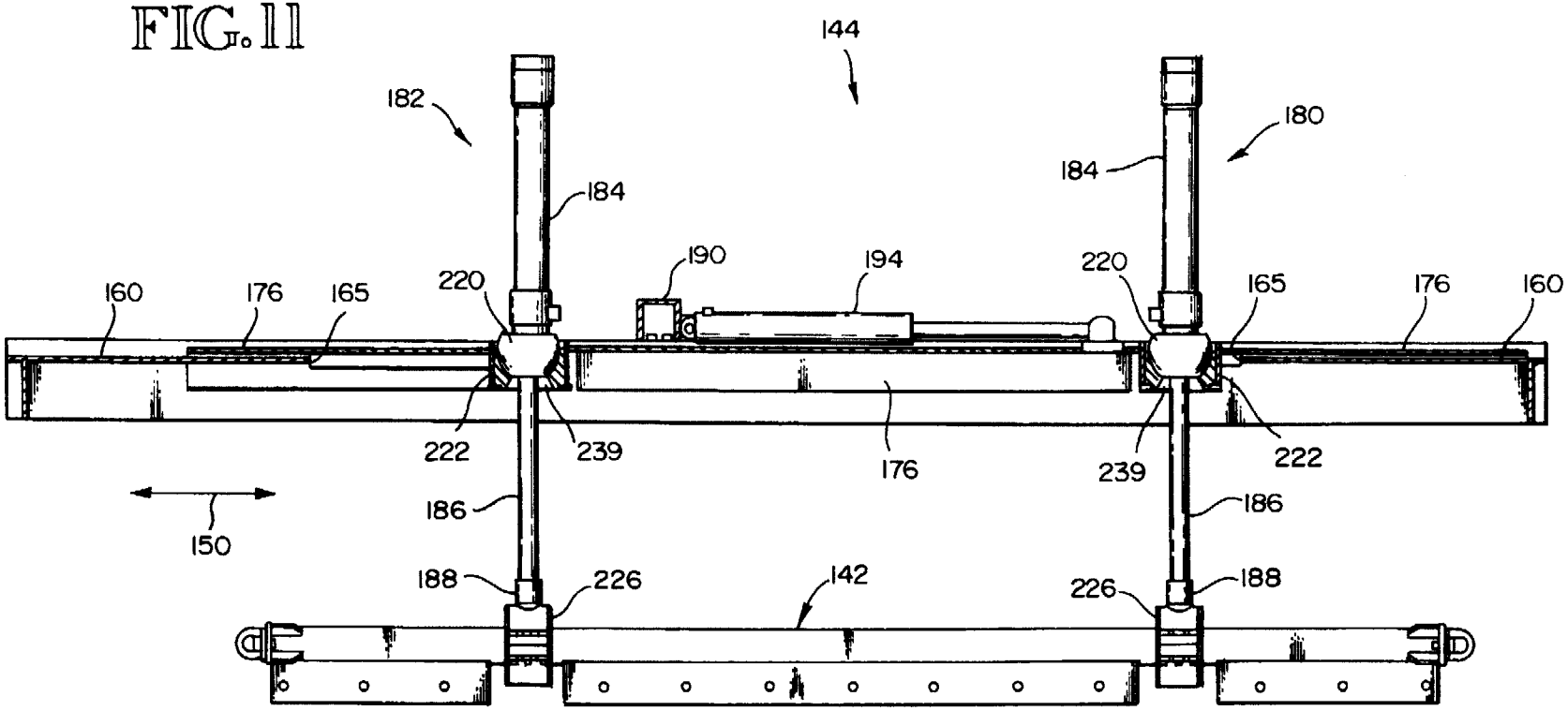
FIG. 11 is a sectional view taken along the line 11—11 of FIG. 10, showing the chain wall assembly.

Referring to FIG. 11, control assembly 144 is shown in more detail. Laterally-extending slot 165 extends beyond the spacing between vertical actuators 180, 182. Actuators 180, 182 are pivotally mounted to socket assemblies 222, which are mounted to channel section 176 and extend through slot 165. Each cylinder component 184 of actuators 180, 182 includes a cylinder end wall 220 in the form of a ball. Socket assemblies 222 are discussed in more detail with reference to FIG. 12. Piston rods 186 extend through the bottom portion of socket assemblies 222 and are connected to clamp assemblies 226, which secure the distal ends 188 of piston rods 186 to movable support bar assembly 142.

Figure 12:
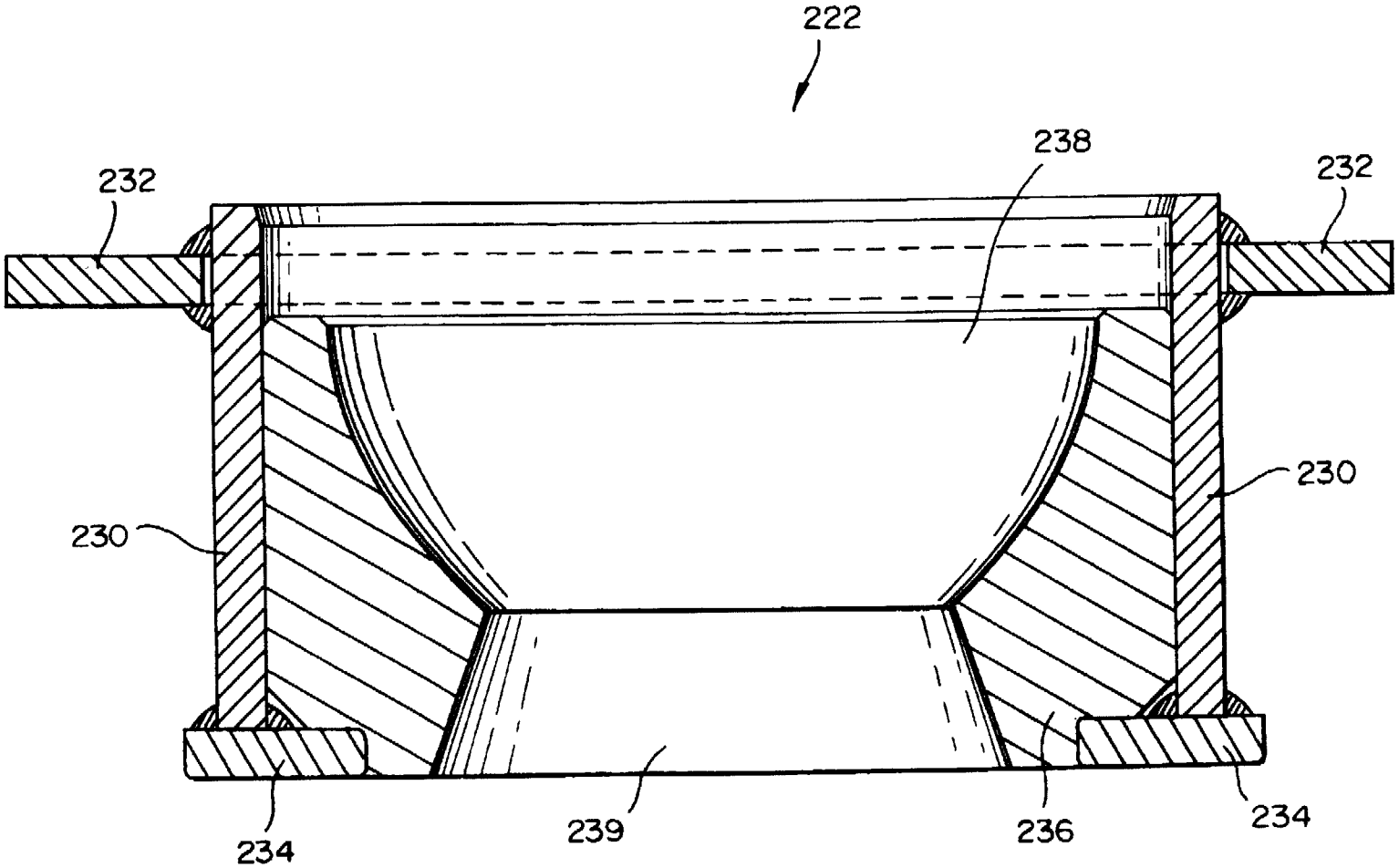
FIG. 12 is a sectional view of a socket assembly of FIG. 11.

Referring to FIG. 12, socket assemblies 222 are identical and only one is shown. Socket assembly 222 includes a cylindrical socket barrel 230, an annular upper flange 232 welded to barrel 230, a lower annular flange 234 welded to barrel 230 and a UHMW socket mount 236. Socket mount 236 forms an inner bowl-shaped area 238 for receiving the ball end 222 of a cylinder component 184. Socket mount 236 also forms a lower circular opening 239 that has outwardly-angled sidewalls. Referring back to FIG. 11, it can be seen that piston rods 186 extend through opening 239. Opening 239, with its angled sidewalls, provides piston component 186 sufficient space to move, thus allowing ball end 220 to pivot universally with respect to hat channel 176 within socket mount 236. In operation, hat channel section 176 is reciprocated laterally, as indicated by arrow 150 in FIG. 11, causing the chain curtain to engage and pull on the bulk material moving through the collector bins. As the bulk material resists the pulling forces of the chains, vertical actuators 180, 182 are allowed to pivot to accommodate the pulling forces of the bulk material, which assists in breaking up the bulk material.

Figure 13:
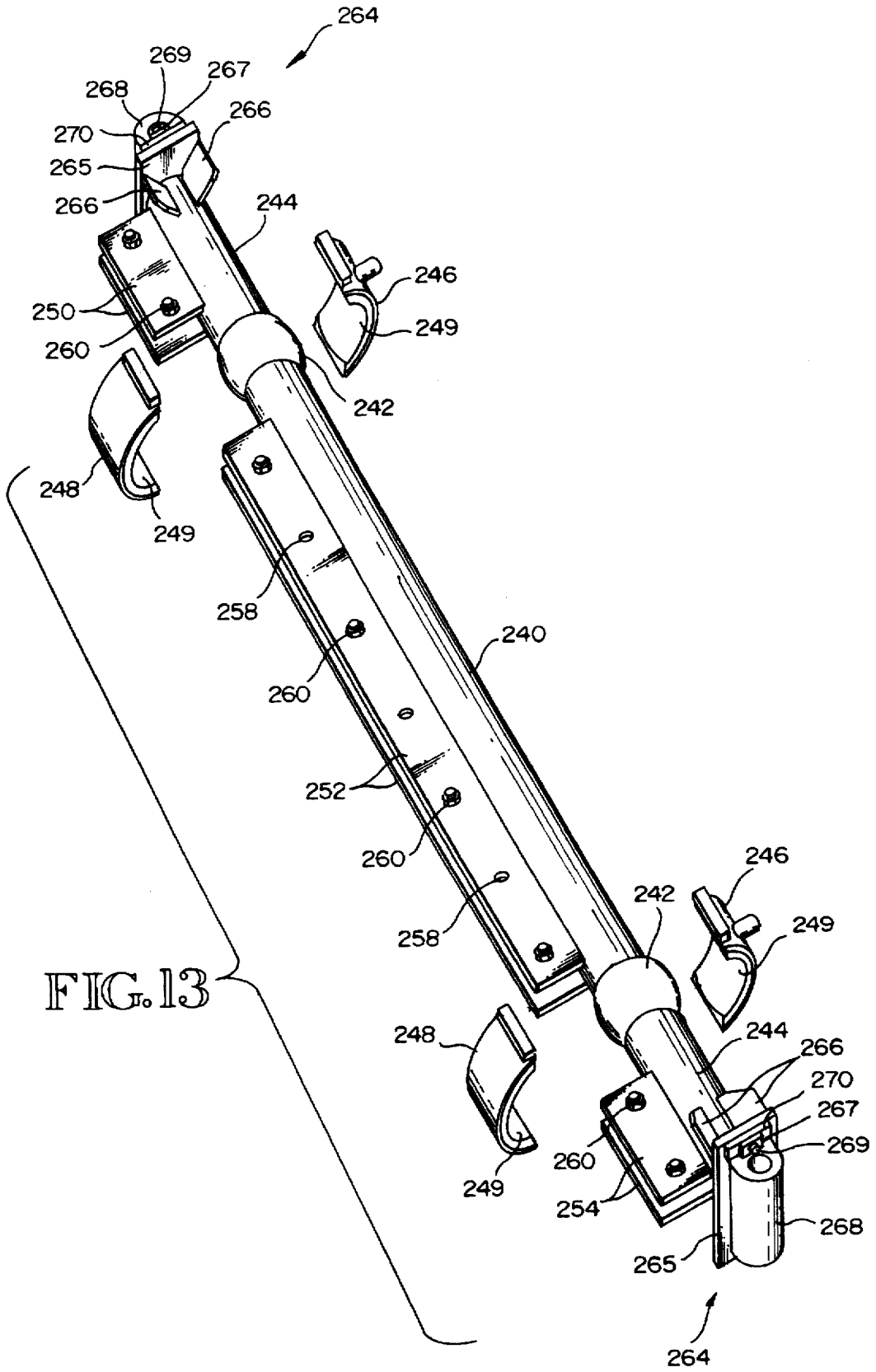
FIG. 13 is a pictorial view of a mounting bar assembly of FIG. 11.

FIG. 13 is a partially-exploded view of the movable support bar assembly 142. Movable support bar assembly 142 includes an elongated cylindrical bar 240 with ball sections 242 mounted at either end. Ball sections 242 are each tubular segments that have had their outer surfaces machined to a ball shape. Outer bar segments 244 are mounted to ball sections 242 to form the main support structure of movable support bar assembly 142. Clamps 246, 248 each include a UHMW bearing socket 249 shaped to conform to ball sections 242. Clamps 246, 248 and bearings 249 clamp around ball sections 242 and are secured to the distal ends of the piston rods of the two vertical actuators. Ball sections 242 and bearings 249 allow movable support assembly 142 to rotate relative to the piston rods. Bolts for securing clamps 246, 248 together are not shown.

Pairs of clevis rails 250, 252, 254 are spaced from each other and welded to the under sides of bars 240, 244. Rails 250, 252, 254 include aligned openings 258 for receiving pins 260. The upper chain link (not shown) of each chain is carried between a pin 260 and bar 240, 244. As such, the chains are suspended from rails 250, 252, 254 and are free to move laterally about pins 260.

At the outward ends of bars 244, bumper assemblies 264 are mounted to cushion lateral engagement of movable support bar assembly 142 with the sidewalls of compartment 120. Bumper assemblies 264 each include an end plate 265 welded to the ends of outer bars 244 and reinforced thereto by gussets 266. A clamp bar 267 clamps an end bumper 268 to end plate 265. Clamp bar 267 extends through end bumper 268 and is secured to end plate 265 by means of bolts 269 and shims 270. End bumper 268 is made of a flexible material such as rubber.

Figure 14:
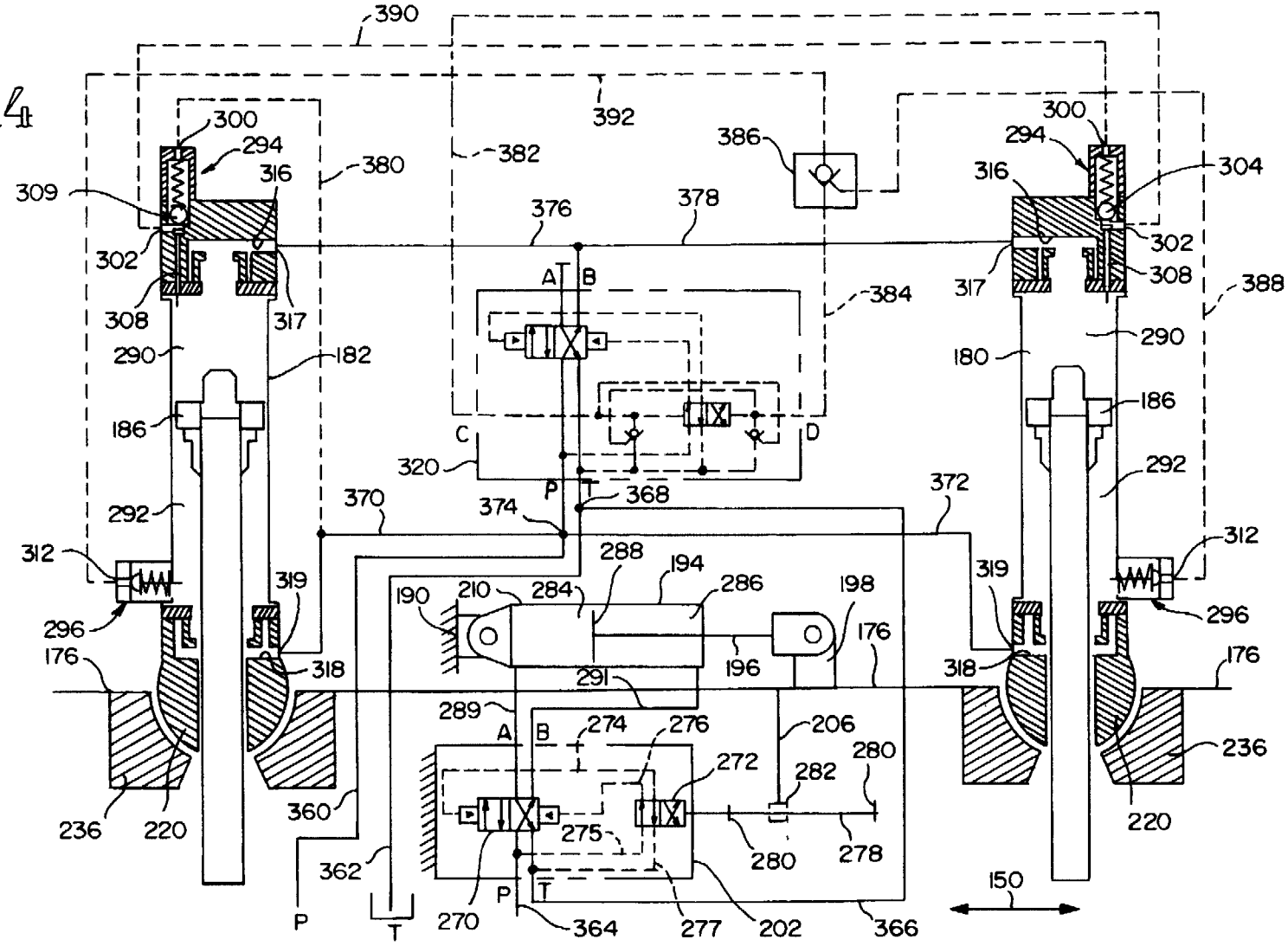
FIG. 14 is a schematic hydraulic control diagram showing operation of a chain wall assembly.

Referring to FIG. 14, a schematic hydraulic control diagram is shown for controlling vertical actuators 180, 182 and horizontal actuator 194. Schematically shown are socket mounts 236, hat channel section 176, brace 190, bracket piece 206, and brace 198. Switching valve 202 is shown to include a four-way, two-position movable valve component 270, a pilot valve 272, ports A and B leading from valve component 270 and ports P and T for connection to pressure and return. Internal pilot lines 274, 276 lead from pilot valve 272 to valve component 270 and allow for the flow of hydraulic pressure to be directed to either side of movable valve component 270 to control which ports A and B receive pressure and return. Pilot lines 275, 277 lead from ports P, T to pilot valve 272. Pilot valve 272 is connected to a valve rod 278, which includes spaced-apart stops 280. Sleeve 282 is mounted to bracket 206 and slides along valve rod 278 as hat channel 176 is moved laterally, in the direction indicated by arrow 150.

Horizontal actuator 194 includes a first working chamber 284 and a second working chamber 286 defined by piston head 288 and cylinder component 210. First working chamber 284 is connected to port A of switching valve 202 via line 289, and second working chamber 286 is connected to port B via line 291.

Vertical actuators 180, 182 each include a first working chamber 290, a second working chamber 292, a first check valve 294 and a second check valve 296. Vertical actuators 180, 182, and particularly check valves 296, are discussed in more detail in my co-pending patent application, Ser. No. 08/561,378 entitled, "Hydraulic Valve," filed Nov. 21, 1995 now U.S. Pat. No. 5,562,018. Check valves 294 each include a first port 300 and a second port 302. An internal valve ball plug 304 is spring-biased to close off fluid communication between ports 300 and 302. A displaceable valve actuator 308 unseats valve plug 304 when piston component 186 engages actuator 308 and displaces it longitudinally against valve plug 304.

Second check valve 296 is disclosed in detail in the aforementioned co-pending patent application and it includes a port 312 and an internal valve stem that is displaced by piston component 186 to open a spring-biased internal valve plug and provide fluid communication between port 312 and second working chamber 292.

Each actuator 180, 182 includes internal passageways 316 leading from first working chambers 290 to ports 317, and internal passageways 318 leading to ports 319.

Figure 15:
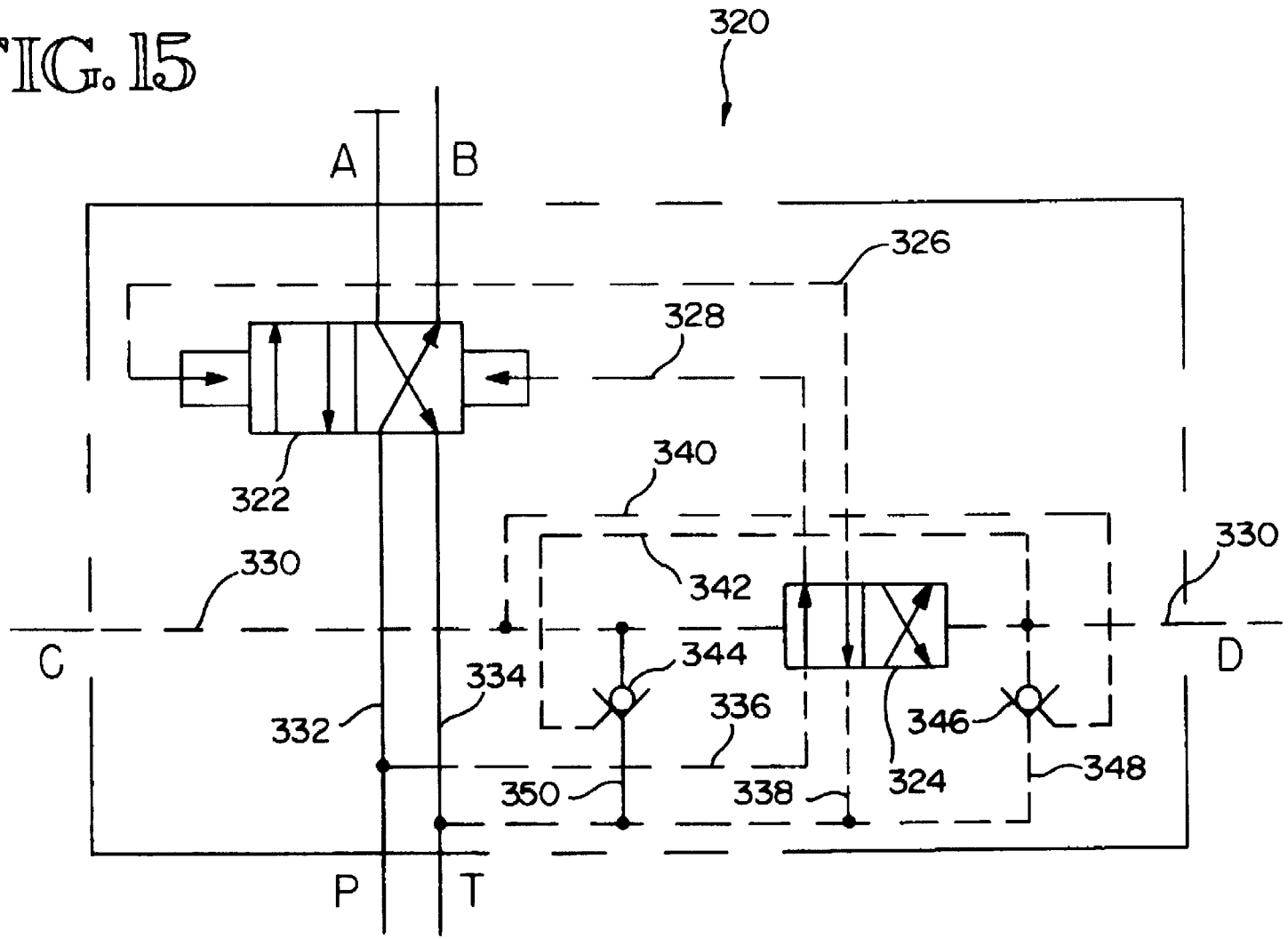
FIG. 15 is a schematic diagram of the switching valve of FIG. 14 for operating vertical actuators of the chain wall assembly.

A second switching valve 320 controls operation of vertical actuators 180, 182. As best shown in FIG. 15, switching valve 320 includes a linearly displaceable four-way, two-position valve component 322, a linearly displaceable pilot valve 324, ports A and B, C and D, and ports P and T. Internal pilot lines 326, 328 allow pilot valve 324 to direct pressure to either side of movable valve component 322 to control pressure flow to ports A and B. Pressure lines 332, 334 extend between ports P and T and valve component 322. Pilot valve 324 is movable between two positions by pressure in an internal pilot line 330, which extends from port C to port D. Pilot lines 336, 338 lead from pressure lines 332, 334 to pilot valve 324. A pair of internal pressure relief lines 340, 342 lead from opposite sides of pilot valve 324 to internal check valves 344, 346, which, when displaced, connect line 330 through lines 348, 350 to tank T.

Referring back to FIG. 14, pressure lines 360, 362 lead from pressure P and tank T to ports P and T of switching valve 320. Pressure line 364 delivers pressure to port P of switching valve 202. Line 366 connects port T of switching valve 202 to line 362 at junction 368. Pressure lines 370, 372 extend from junction 374 and lead to ports 319 of actuators 180, 182. Pressure lines 376, 378 lead from port B of switching valve 320 to ports 317 of activators 180, 182.

Pilot line 380 leads from pressure line 370 to port 300 of check valve 294 of vertical actuator 182. Pilot line 382 leads from port C of switching valve 320 to port 302 of check valve 294 of vertical actuator 180. Pilot line 384 leads from port D of switching valve 320 to the low side of a check valve 386. Pilot line 388 leads from port 312 of check valve 296 of vertical actuator 180 to the low side of check valve 386. Pilot line 390 extends between port 302 of check valve 294 of vertical actuator 182 to port 300 of check valve 294 of vertical actuator 180. And finally, a pilot line 392 connects port 312 of check valve 296 of actuator 182 to the high side of check valve 386.

Referring to FIGS. 14 and 15, in operation, pressure from line 360 moves through lines 370, 372 and into the second working chambers 292 of each vertical actuator 180, 182. Pressure also enters port P of switching valve 320 and moves through line 332 to valve component 322. Pressure also moves through line 336 to pilot valve 324 and into line 328, causing valve component 322 to shift to the left as shown, which allows pressure to move through line 332 to port B of switching valve 320. From port B, pressure moves through lines 376, 378 to the first working chambers 290 of actuators 180, 182. Piston components 186 of each actuator are extended due to the greater surface area of the piston components subject to pressure in first working chambers 290. When piston components 186 trip second check valves 296, pressure is ported through lines 392 and 388 to check valve 386. Pressure from line 388 displaces check valve 386 and ports pressure into line 384 to line 330 of switching valve 320. Pressure moves through line 342 and displaces check valve 344, which connects port C and the left side of line 330 to tank, through line 350. Pilot valve 324 moves to the left.

With pilot valve 324 in its second position, pressure moves through line 336 into line 326, which moves valve component 322 into its second position connecting port P with port A and port T with Port B. In this position, port B is connected to tank, which means that the first working chambers 290 of each vertical actuator 180, 182 are connected to tank, while second working chambers 292 of each actuator are still connected to pressure. This causes piston components 186 to retract into the cylinder components of actuators 180, 182.

When piston components 186 engage valve actuators 308 and displace valve ball plugs 304 of actuators 294, pressure in low pressure line 380 moves through port 300 and out port 302 of check valve 294 of actuator 182 and into line 390. From line 390, pressure enters port 300 of actuator 180 and moves out port 302 into line 382. Pressure from line 382 enters port C of switching valve 320 and enters internal line 330 and moves through line 340 to displace check valve 346. This connects port D and the right side of line 330 to tank, through line 348. Pilot valve 324 moves to the right, into the position shown. With pilot valve 324 in its first position, pressure in line 336 moves into line 328 and shifts valve component 322 back to its original position, establishing high pressure into lines 376, 378 and into the first working chamber 290 of each vertical actuator 180, 182. The process then repeats itself.

Meanwhile, pressure from line 364 enters through port P of switching valve 202 and moves through lines 275, 276 to move valve component 270 to the left, as shown in FIG. 14. Pressure from port P moves out port B through line 291 and enters second working chamber 286 of horizontal actuator 194. Fluid in first working chamber 284 vents to tank T via lines 289, 366, 362. Piston component 196 moves to the left or retracts, which moves the hat channel 176, as well as vertical actuators 180, 182, to the left, indicated by arrow 150.

As hat channel 176 moves to the left, sleeve 282 connected to bracket piece 206 slides along valve rod 278 and eventually engages inner stop 280. This causes pilot valve 272 to shift to its second position, establishing pressure in line 274 and connecting line 277 to tank. This causes valve component 270 to shift to its second position, connecting port P with port A and, thus, pressure to first working chamber 284 of actuator 194. Second working chamber 286 is connected to tank T.

Piston component 196 extends out of cylinder component 210 and moves hat channel 176 to the right. Sleeve 282 eventually engages the outer stop 280, causing pilot valve 272 to shift into its first position. This reconnects pressure to line 276 and shifts valve component 270 back to its original position. The process then repeats itself. As can be seen, horizontal actuator 194 operates independently of vertical actuators 182.

Figure 16:
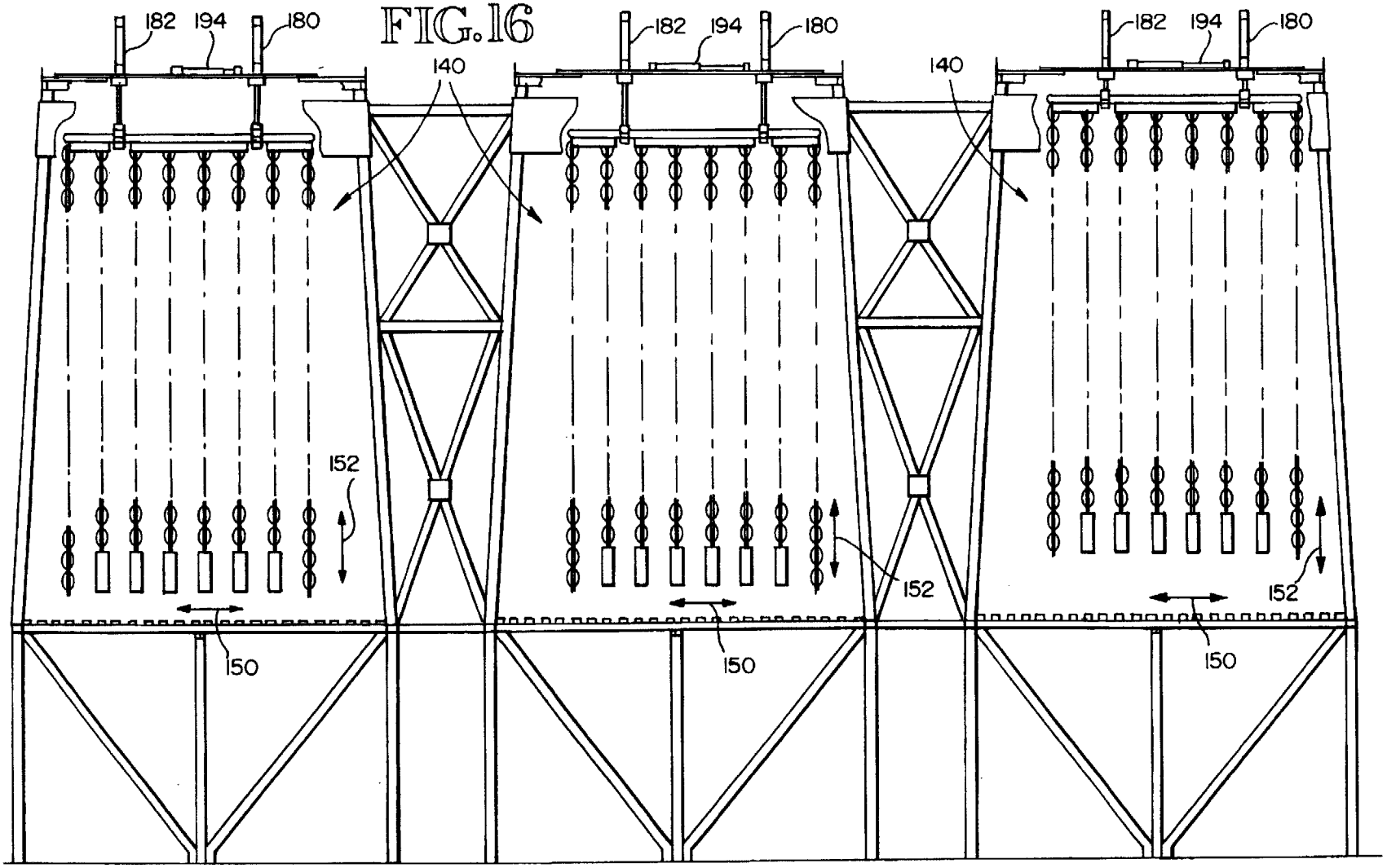
FIG. 16 is an end elevation view of three side-by-side chain curtain assemblies.

As shown in FIG. 16, operation of actuators 180, 182 and horizontal actuator 194 causes chain curtains 140 to move up and down, as indicated by arrows 152 and laterally sideways, as indicated by arrows 150. As each chain curtain 140 is operated in this manner, bulk material moving underneath the lower portions of the chains is manipulated by the chains in a manner that breaks up the bulk material into more manageable pieces.

The movable support is moved in a controlled manner, yet the chains move in an irregular manner to assist in breaking up the garbage. As a result, compacted garbage is pulled and twisted apart before it moves off of the conveyor and out of the collector bin.

Figure 17:
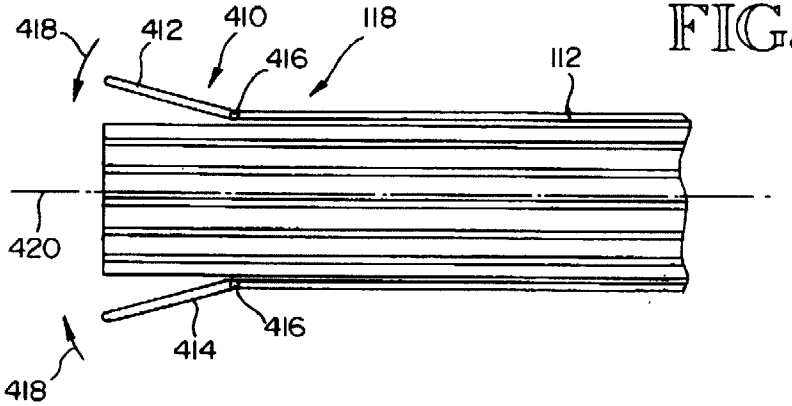

In FIG. 17, an alternate embodiment of a bulk material break-up device 410 is illustrated. Bulk material break-up device 410 includes a pair of hinged doors 412, 414. Vertical doors 412, 414 pivot about hinges 416 in the direction indicated by arrows 418. As bulk material moves along conveyor path 420 and out of the outlet end 118 of collector bin 112, doors 412, 414 pivot inwardly and outwardly to break up the bulk material.

Figure 18:
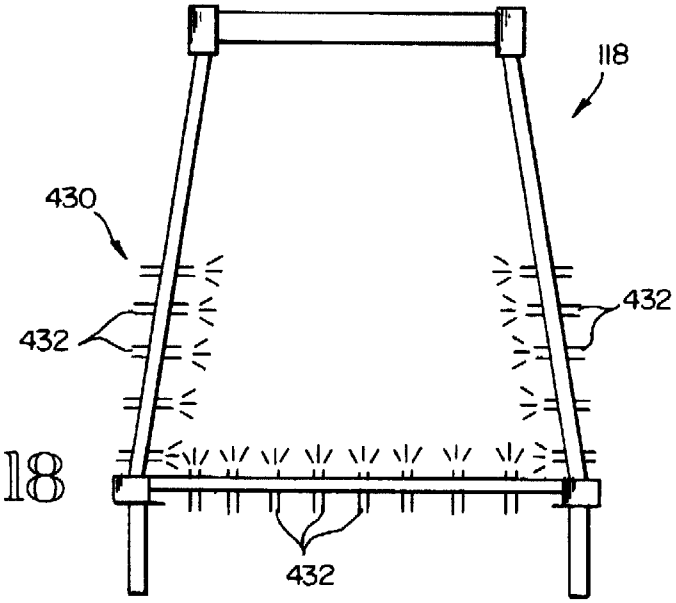

In FIG. 18, another alternate embodiment of a bulk material break-up device 430 is illustrated in schematic form. A plurality of air jets 432 are spaced around the floor and sidewalls of outlet end 118. An air compressor (not shown) directs high pressure air through jets 432 and against bulk material to break up any compacted bulk material.

Figure 19:
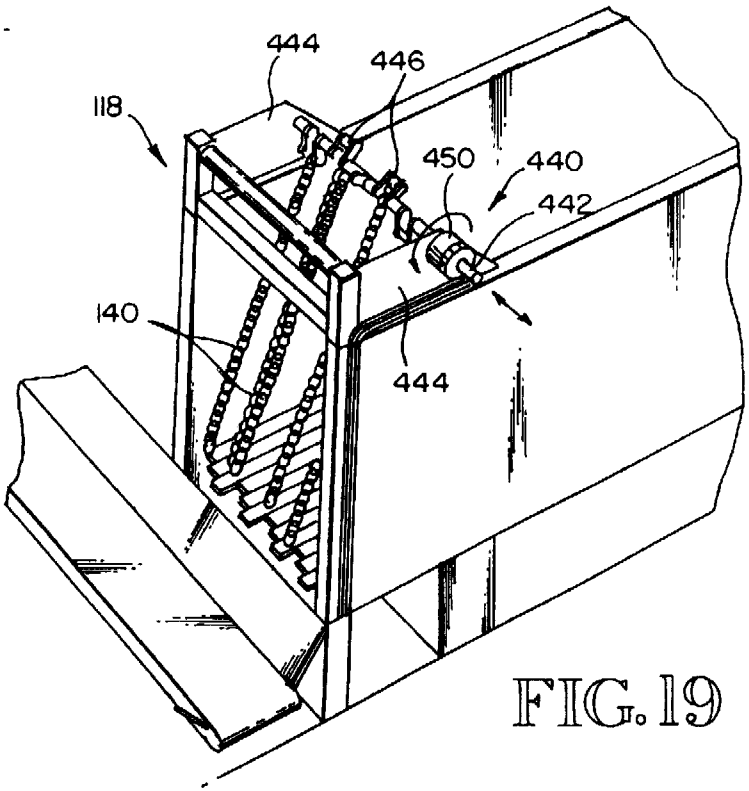
FIGS. 17–19 are views showing alternate embodiments of a garbage break-up device for positioning at the outlet ends of the collector bins of FIGS. 1, 5.

In FIG. 19, another alternate embodiment of a movable support 440 for chains 140 is shown. Movable support 440 includes a crank shaft 442 rotatably supported between plates 444. Each chain 140 is connected to a throw 446 of crank shaft 442. Throws 446 are radially offset from one another in order to stagger the movement of chains 140. An electric motor 450 rotates crank shaft 442. Chains 140 are raised and lowered in a staggered manner as crank shaft 442 is rotated.

Figure 20:
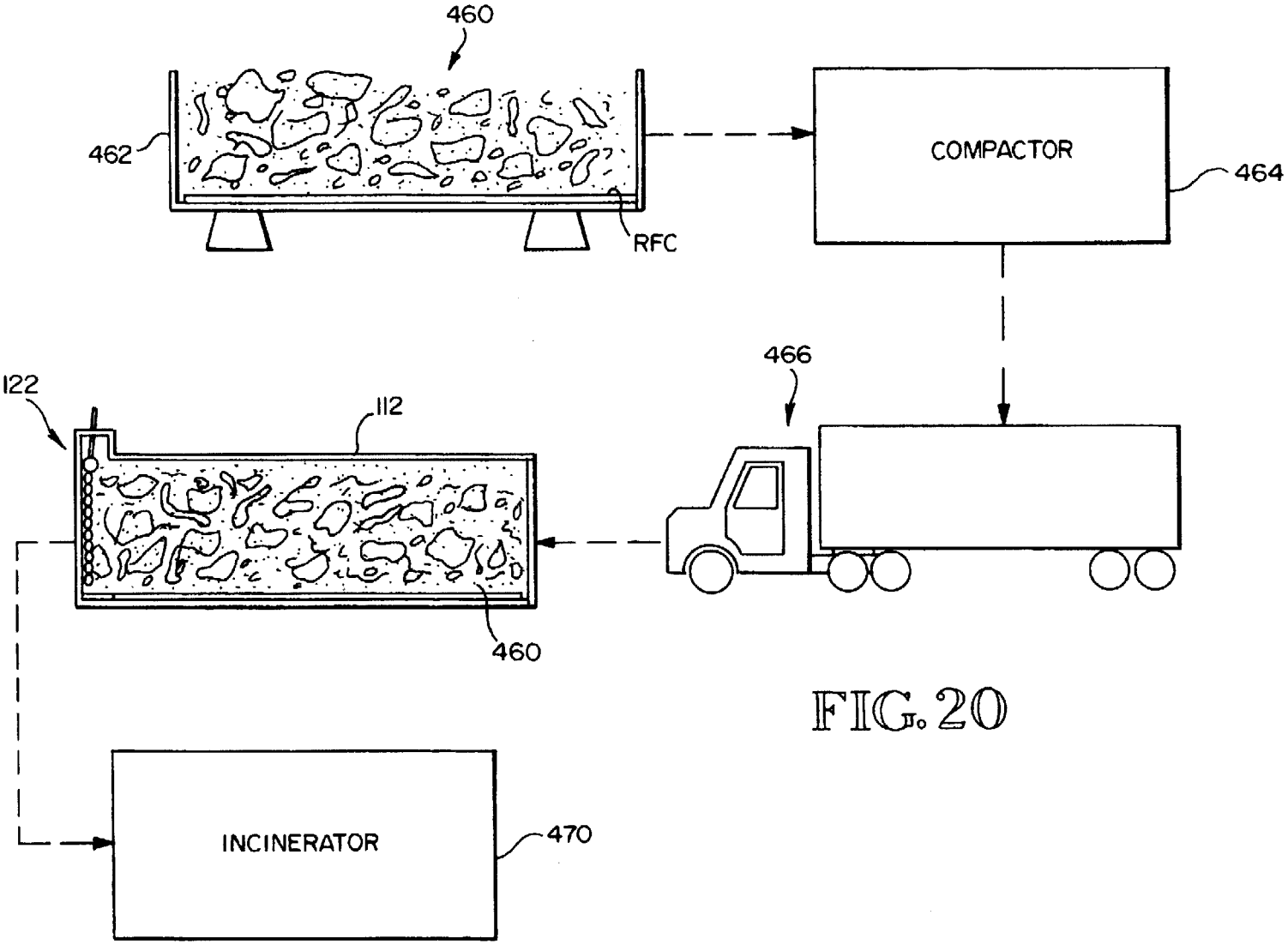
FIG. 20 is a schematic diagram of the method and apparatus of handling garbage of the present invention.
Figure 21:
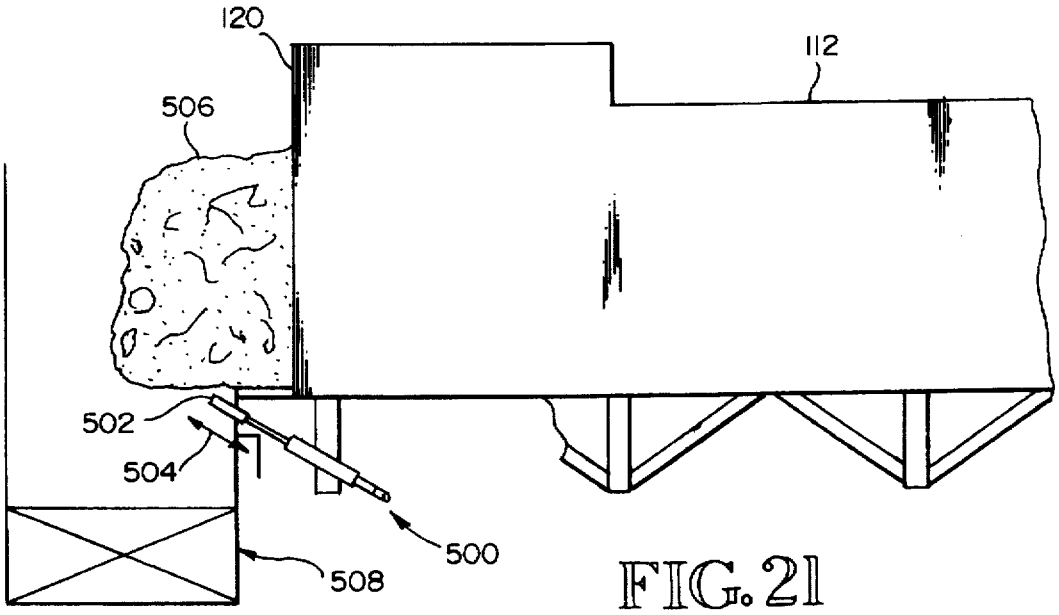
FIG. 21 is a schematic side view of the outlet end of a collector bin with an alternative embodiment of a bulk material break-up device.
Figure 22:
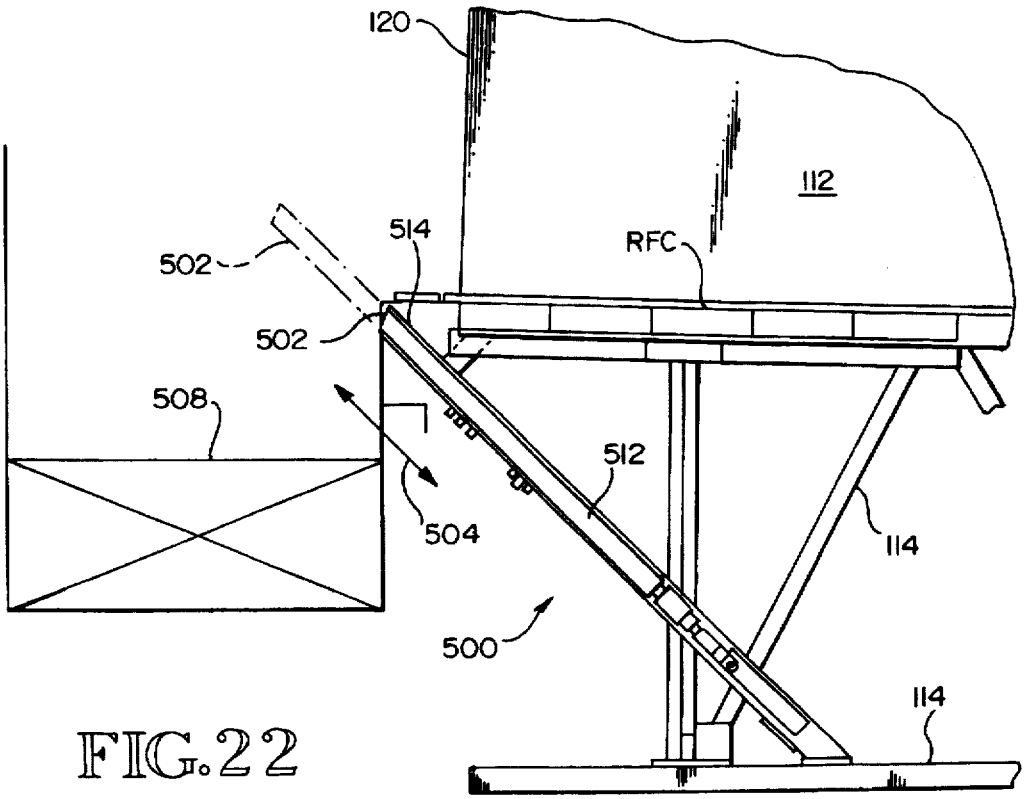
FIG. 22 is an enlarged detail view of the bulk material break-up device of FIG. 21.

In FIG. 20, a schematic diagram illustrates the broad method of the present invention. The method includes the steps of collecting garbage 460 in a first collector bin 462 having a reciprocating floor conveyor RFC. Garbage 460 is conveyed by reciprocating floor conveyor RFC out of collector bin 462 and into a compactor 464. Compactor 464 compacts the garbage for transport, such as for transport to an incinerator. A tractor/trailer 466 hauls the compacted garbage to any one of the collector bins 112 previously discussed. Reciprocating floor conveyors in the trailer of tractor/trailer 466 and in collector bin 112 move compacted garbage 460 into collector bin 112. Garbage break-up device 122 breaks up the compacted garbage 460 as it exits collector bin 112 and is moved into incinerator 470. Collector bin 112 typically would comprise a series of collector bins having sufficient volume to hold enough garbage to allow incinerator 470 to burn for several days while garbage is not being delivered to the collector bins.

FIGS. 21–24 illustrate an alternative embodiment for a bulk material break-up device 500 that can be used in lieu of or in conjunction with the chain wall assembly 30 of FIG. 1 or the chain wall assembly 122 of FIG. 5. Break-up device 500 comprises an extendable ram device 502 in the form of a tubular beam. Ram 502 is movable along a linear path, in the direction indicated by arrow 504, into and out of the path of movement of bulk material 506. Should bulk material 506 remain clumped or bound together as it moves out of outlet compartment 120 of collector bin 112, ram 502 engages the bottom portions of bulk material 506 to break apart the bulk material so that it will fall in a uniform and controlled manner onto a secondary conveyor 508. Break-up device 500 includes, in addition to ram 502, a linear hydraulic motor 512 secured at one end to the support structure 114 for supporting collector bin 112, and at its other end to ram 502. A tubular guide 514 is provided to guide ram 502 along its linear path as ram 502 is extended and retracted. Guide 514 is fixedly secured to support structure 114. In its retracted position, ram 504 is beneath the reciprocating floor conveyor RFC within collector bin 112, and in its extended position is above the reciprocating floor conveyor RFC. However, ram 502 could be positioned above, or at the sides of, reciprocating floor conveyor RFC.

Figure 23:
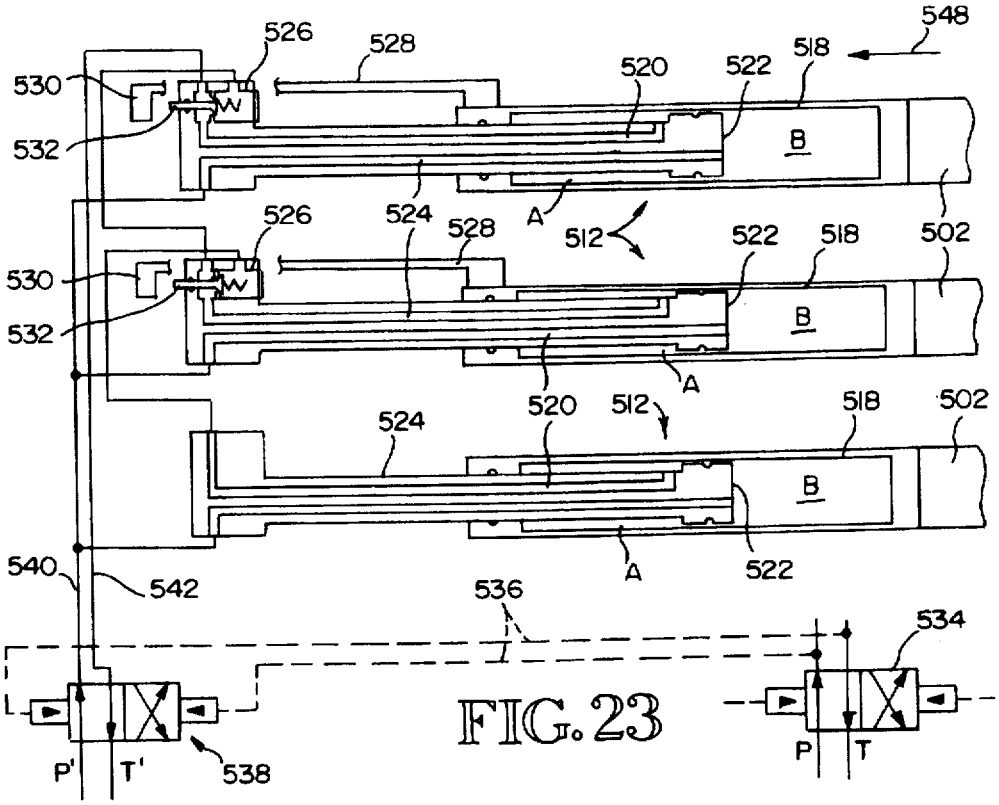
FIGS. 23–24 are two different hydraulic circuit diagrams for controlling the linear hydraulic motors of the bulk material break-up device of FIGS. 21–22.
Figure 24:
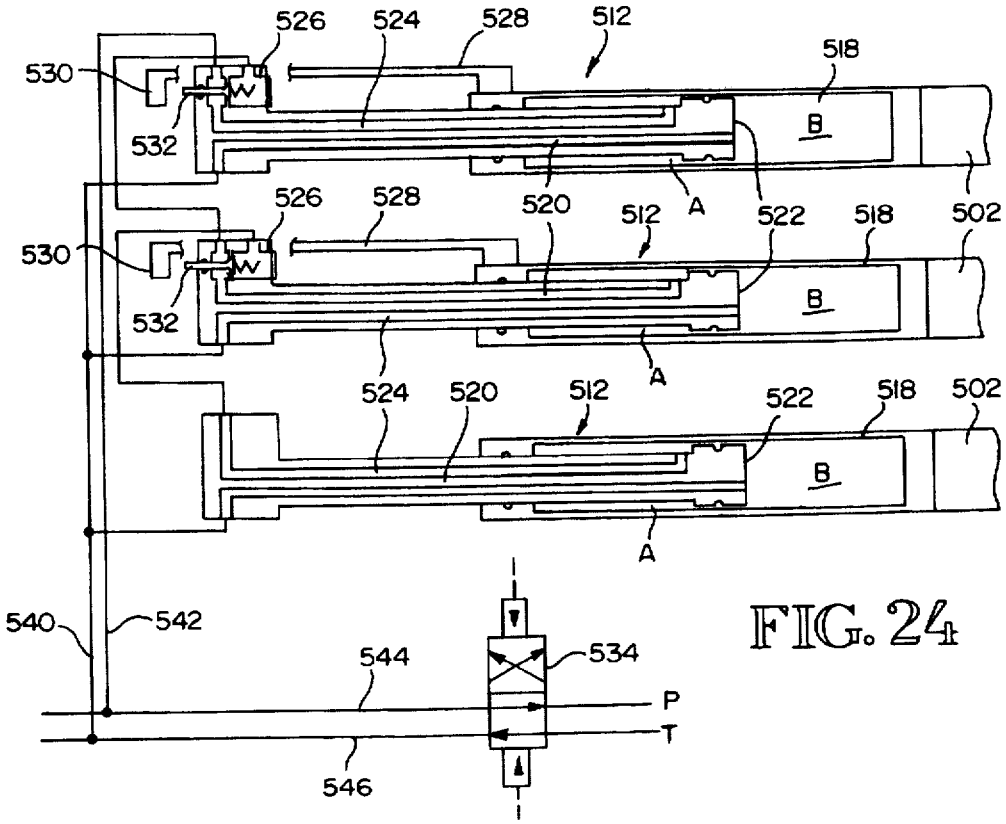

Referring to FIGS. 23–24, preferably, three separate ram devices 502 are provided to move in conjunction with each other to break up the bulk material. Each ram 502 is secured to one end of a cylinder component 518 of each linear hydraulic motor 512. Cylinder components 518 reciprocate on piston components 520, which each include a piston head 522 and a piston rod 524. Piston heads 522 and cylinder components 518 define a pair of fluid working chambers A, B in each motor 512. A check valve 526 is provided in two of the three motors 512, and a mechanical pull arm 528 is attached to the cylinder components 518 of the two corresponding motors 512. Each pull arm 528 extends from one end of its corresponding cylinder component 518 beyond check valves 526 and includes an abutment 530 for engaging a valve stem 532 of check valve 526.

Switching valve 534 is the switching valve for the main hydraulic circuitry of the reciprocating floor conveyor of the collector bin. In FIG. 23, a pair of pilot lines 536 lead from the pressure P and tank T lines to a second two-position switching valve 538. Lines P' and T' lead from a second hydraulic pump and tank that function to provide fluid power to motors 512. Pressure lines 540, 542 lead from switching valve 538 to fluid conduits within piston rods 524.

In FIG. 24, a second switching valve is not provided, and lines 540, 542 tap directly into the main pressure lines 544, 546 of the hydraulic circuitry for the reciprocating floor conveyor. Provision of a second switching valve 538 may be preferable in applications where lines 544, 546 are of substantial length sufficient to create fluid circulation problems through motors 512. The circuitry of FIG. 23 eliminates fluid circulation problems by eliminating lines 544, 546 and providing a secondary hydraulic pump adjacent motors 512.

In operation, when the reciprocating floor conveyor is advancing the load out of the collector bin, pressure from line P (or P') moves through line 542 and into working chamber A of the first hydraulic motor 512. Fluid pressure also opens check valve 526, which establishes fluid pressure into working chamber A of the middle hydraulic motor 512 and which also opens check valve 526 for that motor. Pressure continues into working chamber A of the third motor 512. All three cylinder components 518 and rams 502 retract, in the direction indicated by arrow 548.

When the reciprocating floor conveyor retracts, switching valve 534 switches, establishing pressure into line 540, which introduces pressure directly into all three working chambers B of motors 512. However, only the first motor 512 (the upper one, as shown) extends, because fluid in its working chamber A can exhaust through line 542 back to tank. Pressure in the working chambers A of the other two motors is blocked by the pair of check valves 526. When cylinder component 518 of the first motor 512 is fully extended, its pull arm 528 unseats valve 532, which allows fluid in working chamber A of the second motor 512 to return to tank T through the check valve 526 of the first motor. When cylinder component 518 of the second motor 512 is fully extended, its pull arm 528 unseats valve 532, which allows fluid in working chamber A of the third motor to return to tank through both check valves 526. The process then continues to repeat itself. Thus, the ram devices 502 extend one at a time into the path of the bulk material, and are retracted together in unison. Since there is little to inhibit the retraction of motors 512, they tend to retract immediately prior to the load being advanced any further by the reciprocating floor conveyor.

It is to be understood that many variations in size, shape, and construction can be made to the illustrated and above-described embodiment without departing from the spirit and scope of the present invention. Some of the features of the preferred embodiment may be utilized without Other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalents and reversal of parts.

What is claimed is:

1. A bulk material handling system, comprising:

a collector bin for receiving bulk material, the collector bin including a floor, a pair of sidewalls, and an outlet end, said floor comprising a reciprocating slat conveyor having a discharge end and including a plurality of longitudinally reciprocable conveyor slats for conveying the bulk material through the collector bin and out the outlet end thereof, and a bulk material break-up device positioned at the outlet end of the collector bin and at the discharge end of the slat conveyor for loosening bulk material that is bound together, as the bulk material is moved by said slat conveyor out of the collector bin.

2. A bulk material handling system according to claim 1, wherein the bulk material break-up device includes a plurality of chains at said outlet suspended from above the bulk material to form a chain wall.

3. A bulk material handling system according to claim 2, wherein some of the chains include weights attached to their lower ends.

4. A bulk material handling system according to claim 2, wherein the plurality of chains are attached to a movable support that is movable laterally and vertically, so that the chains can be moved laterally and vertically, to assist in breaking up bulk material.

5. A bulk material handling system according to claim 4, wherein the movable support includes a bar for holding the chains and a pair of actuators for moving the bar, the actuators being pivotally secured to allow the bar to move longitudinally along the conveyor.

6. A bulk material handling system according to claim 5, wherein the actuators are linear motors, each including a cylinder component and a piston component, the cylinder component including a pair of end walls, one of which is in the form of a ball, and further comprising a channel beam for carrying the motors and a socket for each ball mounted to the channel beam, whereby the linear motors can universally pivot with respect to the channel beam.

7. A bulk material handling system according to claim 5, wherein the channel beam is slidably mounted to a fixed frame member for reciprocating movement transverse to the longitudinal reciprocation of the conveyor slats.

8. A bulk material handling system according to claim 7, wherein the linear motors are mounted vertically on the channel beam, with the ball of each motor supported by one of the sockets on the channel beam, and with the piston component of each linear motor extending through a slot in the fixed frame member, the movable support bar being mounted to the piston components beneath the channel beam.

9. A bulk material handling system according to claim 1, wherein the sidewalls of the collector bin are angled toward each other, so that the spacing between upper portions of the sidewalls is less than the spacing between lower portions of the sidewalls.

10. A bulk material handling system according to claim 1, wherein the bulk material break-up device comprises a pair of movable panels at said outlet, pivotally secured to pivotally move toward and away from the bulk material as it is moved by the slat conveyor through said outlet.

11. A bulk material handling system according to claim 1, wherein the bulk material break-up device at said outlet comprises a plurality of air jets directed at the bulk material as it is moved by the slat conveyor through said outlet.

12. A bulk material handling system according to claim 1, wherein the bulk material break-up device at said outlet comprises a ram device movable into and out of the path of movement of the bulk material to engage the bulk material and break it apart as it is moved by the slat conveyor through said outlet.

13. A garbage handling system comprising a first collector bin having a reciprocating slat conveyor as its floor, a compactor for compacting garbage received from the first collector bin, a second collector bin having a reciprocating slat conveyor as its floor and an outlet and a garbage break-up device positioned at said outlet, a garbage hauling vehicle for transferring compacted garbage from the compactor to the second collection bin, an incinerator for burning the garbage from the second collector bin, continuously at a predetermined amount per day, and the second collector bin having sufficient volume to hold enough garbage for the incinerator to burn garbage continuously at such predetermined amount per day for at least a period of two days.

14. A bulk material handling system according to claim 13, wherein the first collector bin includes a garbage break-up device for breaking up the garbage as it is conveyed out of the first collector bin to the compactor.

15. A bulk material handling system according to claim 13, wherein the garbage break-up device includes a plurality of chains suspended from above the reciprocating slat conveyor to form a chain wall through which the garbage moved by the reciprocating slat conveyor.

16. A bulk material handling system according to claim 15, wherein the chains are carried by a movable support capable of moving the chains laterally and vertically, to assist in breaking up the garbage.

17. A bulk material handling system according to claim 16, wherein some of the chains include weights attached at their lower ends.

18. A method of handling bulk material, comprising the steps of delivering bulk material to a collector bin, operating a reciprocating slat conveyor comprising the floor of the collector bin to move the bulk material out of one end of the collector bin, and operating a bulk material break-up device at said one end of the collector bin, so that any bulk material bound together is loosened by the break-up device substantially as it exits from the collector bin.

19. A method of handling bulk material according to claim 18, and further comprising the step of conveying the loosened bulk material from the collector bin to a subsequent processing station.

20. A method of handling bulk material according to claim 18, wherein the bulk material break-up device includes a plurality of chains attached to a movable support, and further comprising the step of moving the movable support up and down and laterally to assist in loosening the bulk material as the bulk material passes through the chains.

21. A method of handling bulk material according to claim 20, and further comprising the step of allowing the movable support to move longitudinally along the conveyor in response to pulling forces on the chains caused by the bulk material.

22. A method of handling bulk material according to claim 21, wherein the subsequent processing station is an incinerator and further comprising the step of burning the bulk material in the incinerator.

23. A method of handling bulk material according to claim 22, wherein the step of moving the movable support up and down and angularly includes extending and retracting a linear motor connected to each end of the movable support.

24. A method of handling bulk material according to claim 23, wherein the step of allowing the movable support to move longitudinally along the conveyor includes providing a pivotal mount for the linear motors, so that as the linear motors pivot in response to pulling forces on the chains, the chains move longitudinally along the conveyor.

25. A method of handling bulk material according to claim 18, wherein the bulk material break-up device includes a plurality of ram devices movable into and out of the path of movement of the bulk material, and further comprising the step of moving the ram devices into and out of the path of movement of the bulk material to break apart the bulk material as it passes out of the collector bin.

26. A method of handling garbage comprising the steps of collecting garbage in a first collector bin having a floor comprising a reciprocating slat conveyor for conveying the garbage out of the first collector bin, operating said conveyor for conveying the garbage out of the first collector bin and into a compactor, compacting the garbage for transport to an incinerator facility, providing an incinerator at the incinerator facility that is adapted to burn garbage continuously at a predetermined amount per day, transporting the compacted garbage to an incinerator facility, collecting the compacted garbage at the incinerator facility in a second collector bin that is sufficient in size to hold enough garbage for the incinerator to burn garbage continuously at such predetermined amount per day for at least two days, the second collector bin being equipped with a second reciprocating slat conveyor, operating said second slat conveyor for continuously conveying collected garbage out of the second collector bin and through a garbage break-up device capable of breaking up garbage into loose bulk material, transferring broken-up garbage from the second collector bin into said incinerator for burning.

27. A method of handling garbage according to claim 26, wherein the step of transporting compacted garbage to an incinerator facility includes transporting the garbage at a rate sufficient to provide enough garbage for the incinerator to operate continuously during a period of time of frequent deliveries of compacted garbage to the incinerator facility and also to create a large enough backlog of garbage to be burned so that the incinerator can operate continuously during periods of no delivery of garbage to the incinerator facility.

28. A method of handling garbage according to claim 26, wherein the garbage break-up device includes a plurality of chains suspended at one end of the second collector bin so that compacted garbage engages the lower ends of the chains as the garbage moves out of the second collector bin.

29. A method of handling garbage according to claim 28, and further including the step of moving the plurality of chains laterally and vertically, to assist in breaking up the garbage.

30. A method of handling garbage according to claim 26, and further including the step of providing a second garbage break-up device at an outlet end of the first collector bin, so that garbage within the first collector bin is broken up as it exits from the bin.

* * * * *